US010011040B2

(12) United States Patent
Banjo et al.

(10) Patent No.: US 10,011,040 B2
(45) Date of Patent: Jul. 3, 2018

(54) STROKE REDUCER FOR LOG SPLITTING APPARATUS

(71) Applicant: Frictionless World LLC, Westminster, CO (US)

(72) Inventors: Daniel Banjo, Boulder, CO (US); Benjamin Zywicki, Louisville, CO (US)

(73) Assignee: Frictionless World LLC, Westminster, CO (US)

( * ) Notice: Subject to any disclaimer, the term of this patent is extended or adjusted under 35 U.S.C. 154(b) by 235 days.

(21) Appl. No.: 15/144,946

(22) Filed: May 3, 2016

(65) Prior Publication Data

US 2016/0318206 A1 Nov. 3, 2016

Related U.S. Application Data

(60) Provisional application No. 62/156,282, filed on May 3, 2015.

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
See application file for complete search history.

(56) References Cited

U.S. PATENT DOCUMENTS

| | | | | |
|---|---|---|---|---|
| 4,770,218 | A | 9/1988 | Duerr | |
| 5,373,877 | A | 12/1994 | Chapman | |
| 2006/0060262 | A1 | 3/2006 | Hicks | |
| 2010/0024919 | A1 | 2/2010 | Majkrzak | |
| 2011/0304087 | A1* | 12/2011 | Gibson | B27L 7/00 269/305 |
| 2012/0055585 | A1 | 3/2012 | Gassner | |
| 2016/0303760 | A1* | 10/2016 | Manchik | B27L 7/00 |

* cited by examiner

*Primary Examiner* — Matthew G Katcoff
(74) *Attorney, Agent, or Firm* — Marsh Fischmann & Breyfogle LLP; Jonathon A. Szumny

(57) ABSTRACT

A stroke reducing device for a log splitting apparatus that allows a user to dynamically (e.g., on the fly) adjust the stroke of a splitting assembly of the apparatus based on the length or other dimension of wood being split by the apparatus. Upon the splitting assembly retracting by an amount substantially equal to a desired reduced stroke length, the splitting assembly triggers one or more mechanical links of the stroke reducing device that are engaged with or otherwise interconnected with a trigger (e.g., switch, handle, etc.) of a drive assembly (e.g., hydraulic cylinder, etc.) that is retracting the splitting assembly to manipulate the trigger to deactivate the drive assembly and limit further retraction of the splitting assembly.

12 Claims, 19 Drawing Sheets

STROKE REDUCER FOR LOG SPLITTING APPARATUS

CROSS REFERENCE TO RELATED APPLICATION

This application claims priority to U.S. Application No. 62/156,282, entitled "STROKE REDUCER FOR LOG SPLITTING APPARATUS," and filed on May 3, 2015, the entire contents of which are incorporated herein by reference as if set forth in full.

FIELD

The present invention generally relates to field of wood or log splitting apparatuses.

BACKGROUND

The continued popularity of wood as a source of heat has led to increasing use of powered apparatuses for wood splitting purposes. Many different forms of mechanical wood splitters have been developed. One common design includes a blade and foot plate that are spaced apart for the receipt of a log on a cradle member therebetween. One of the blade and foot plate is driven toward the other (e.g., by a drive assembly) to drive the blade through the log to split the same into two or more pieces.

SUMMARY

One concern that can arise with existing log splitting devices is increased cycle times due to inefficient operation of the hydraulic cylinder or other drive mechanism of the log splitting device. Generally, a user manipulates a trigger handle of a log splitting device to linearly move one of the blade member or foot plate towards and away from the other of the blade member or foot plate to split logs or other pieces of wood placed therebetween. As used herein, the term "splitting assembly" refers to the one of the blade member or foot plate that is moving towards and away from the other of the blade member or foot plate that is fixed on the frame of the log splitting device or apparatus (the "fixed member"). The "splitting assembly" may additionally include the piston or other member of the drive mechanism or assembly that is driving or moving the one of the blade member or foot plate towards and away from the fixed member. For instance, manipulating the handle into a first position may trigger the apparatus to pump hydraulic fluid into a first chamber of the hydraulic cylinder and out of a second chamber of the hydraulic cylinder to drive the splitting assembly in a first direction towards one of a fully retracted positioned away from the fixed member or a fully extended position adjacent the fixed member.

The splitting assembly generally continues moving in the first direction until the one of the fully retracted or fully extended positions is reached. That is, the stroke of the splitting assembly typically extends between the fully retracted position and the fully extended position. To stop the splitting assembly at a position between the fully retracted and fully extended positions (i.e., to shorten the stroke), the user typically must manually manipulate the handle out of the first position and into an intermediate position which triggers the apparatus to stop pumping hydraulic fluid into either of the first or second chambers of the hydraulic cylinder.

To move the splitting assembly in the opposite second direction towards the other of the fully retracted or fully extended positions, the user manipulates the handle into a second position (e.g., opposite the intermediate position from the first handle position) to cause the apparatus to pump hydraulic fluid into the second chamber of the hydraulic cylinder and out of the first chamber of the hydraulic cylinder to drive the splitting assembly in the second direction towards the other of the fully retracted or fully extended positions. Again, the splitting assembly typically continues moving in the second direction until the other of the fully retracted or fully extended positions is reached.

When the splitting assembly is in its fully retracted position, a fixed gap exists between the blade and the foot plate in which a log may be placed (e.g., so that the length of the log extends along the fixed gap between the blade and foot plate). In the event the length of the log is about equal to the length of the gap between the blade and the foot plate, the splitting assembly may contact and begin splitting the log substantially immediately after activation of the hydraulic cylinder or other drive mechanism to drive the splitting assembly from the fully retracted position to the fully extended position. If the user needs to split additional logs of the same or similar length, the user can appropriately manipulate the handle to trigger the apparatus to move the splitting assembly back into the fully retracted position, place the new log in the cradle, and then again manipulate the handle to advance the splitting assembly to split the log.

However, even when additional logs of a shorter length (i.e., less than the length of the fixed gap of the cradle, such as, but not limited to, 90% of the length of the fixed gap, 75% of the length of the fixed gap, 50% or less of the length of the fixed gap, etc.) need to be split, many users still manipulate and then let go of the handle until the splitting assembly has reached the fully retracted position. Upon manipulation of the handle to move the splitting assembly towards the extended position to split the log, the splitting assembly has to travel for a portion of the length of the fixed gap before the blade actually begins splitting the log resulting in increased cycle times, wasted fuel and/or electricity, and/or the like.

Even when a user manipulates the handle to stop the splitting assembly from reaching the fully retracted position when the user is splitting a plurality of shorter logs, the user is required to carefully watch the splitting assembly as it moves towards the fully retracted position and manipulate the handle to stop the splitting assembly just as the space between the blade member and foot plate is about equal to the length of the log. If the user is not able to fit the log onto the cradle in the space between the blade and foot plate, the user must then manipulate the handle to slightly move the splitting assembly and then again try to fit the log onto the cradle. This process is only exacerbated with an increase in the number of logs to be split or differences in the lengths of logs to be split.

In view of the foregoing, disclosed herein is a stroke reducing device or apparatus (a "stroke reducer") for a log splitting apparatus that allows a user to dynamically (e.g., on the fly) adjust the stroke of the splitting assembly based on the length or other dimension of wood being split by the apparatus. More specifically, the disclosed stroke reducing device can be used to adjust and limit the stroke of the splitting assembly to be just slightly larger than the length or other dimension of wood to be cut substantially free of a user having to manually manipulate the triggering assembly (e.g., handle) of the drive assembly to achieve such as reduced stroke. Upon the splitting assembly retracting by an amount equal to the particular reduced stroke, the splitting assembly triggers one or more mechanical links of the stroke reducing device that are engaged with or otherwise interconnected with the triggering assembly to simultaneously move the triggering assembly into a position to stop movement of the splitting assembly. Stated differently, the disclosed stroke reducing device uses the force of the splitting assembly as it is retracting away from the split log to trigger the mechanical link(s) to manipulate the triggering assembly into a position that stops movement of the splitting assembly. For instance, in the case of a hydraulic cylinder, the mechanical link(s) manipulate a handle of a valve assembly to close hydraulic fluid passageways into and out of the hydraulic cylinder to stop movement of the splitting assembly.

In one aspect disclosed herein, an apparatus for splitting logs includes a frame having a cradle disposed over an upper portion thereof for receiving a log, a splitting assembly that is linearly translatable over the upper portion of the frame along a translation axis in a first direction for use in splitting a log received in the cradle and in an opposite second direction; a drive assembly for linearly translating the splitting assembly along the translation axis in the first and second opposite directions; and a device secured to the frame that is configured to receive a force from the splitting assembly moving in the second direction and use the force to mechanically deactivate the drive assembly and thereby inhibit translation of the splitting assembly along the translation axis.

In one arrangement, the device may include an anchoring member that is rigidly secured to or relative to the frame; and at least one mechanical link movably secured to the anchoring member that mechanically deactivates the drive assembly upon receipt by the device of the force from the splitting assembly moving in the second direction. For instance, the at least one mechanical link may include a first mechanical link movably secured to the anchoring member and a second mechanical link movably secured to the anchoring member and configured to contact a triggering mechanism of the drive assembly, where receipt by the first mechanical link of the force from the splitting assembly moving in the second direction induces the first mechanical link to move the second mechanical link relative to the anchoring member to manipulate the triggering mechanism of the drive assembly and thereby deactivate the drive assembly. As another example, the anchoring assembly may include a first mounting leg secured to the first side portion of the frame; a second mounting leg secured to the second side portion of the frame; and a platform secured to the first and second mounting legs, wherein the at least one mechanical link is movably secured to the platform.

In another aspect disclosed herein, a method of operating a log splitting apparatus includes operating a drive assembly to retract one of a blade member or foot plate away from the other of a blade member or foot plate of the log splitting apparatus; contacting, with the one of the blade member or foot plate as the one of the blade member or foot plate is being retracted, a mechanical linkage attached to a frame of the log splitting apparatus; moving, with the one of the blade member or foot plate as the one of the blade member or foot plate is being retracted, the mechanical linkage; and manipulating, with the mechanical linkage during the moving, a triggering assembly of the drive assembly to deactivate the drive assembly and inhibit further retraction of the one of the blade member or foot plate.

In one arrangement, the operating may include moving the triggering assembly into a first position, and the manipulating may include moving the triggering assembly into a second position. In one arrangement, the moving may include urging, with the one of the blade member or foot plate, a first mechanical link of the mechanical linkage along a translation axis; and urging, with the first mechanical link, a second mechanical link of the mechanical linkage about a pivot axis to manipulate the triggering assembly to deactivate the drive assembly.

In another aspect disclosed herein, an apparatus for adjusting a stroke of a splitting assembly of a log splitting apparatus includes an anchoring member that is rigidly securable to a frame of a log splitting apparatus; a first mechanical link that is slidably secured to the anchoring member; and a second mechanical link that is pivotally secured to the anchoring member at a pivot axis, where receipt by the first mechanical link of a force from a splitting assembly of the log splitting apparatus as the splitting assembly is being retracted by a drive assembly of the log splitting apparatus slides the first mechanical link to induce pivoting of the second mechanical link to deactivate the drive assembly and inhibit further retraction of the splitting assembly.

Any of the embodiments, arrangements, and the like discussed herein may be used (either alone or in combination with other embodiments, arrangement, and the like) with any of the disclosed aspects. Any feature disclosed herein that is intended to be limited to a "singular" context or the like will be clearly set forth herein by terms such as "only," "single," "limited to," or the like. Merely introducing a feature in accordance with commonly accepted antecedent basis practice does not limit the corresponding feature to the immediately previous occurrence of the feature. Moreover, any failure to use phrases such as "at least one" also does not limit the corresponding feature to the singular. Use of the phrase "generally," "at least generally," "substantially," "at least substantially" or the like in relation to a particular feature encompasses the corresponding characteristic and insubstantial variations thereof. Finally, a reference of a feature in conjunction with the phrase "in one embodiment" or the like does not limit the use of the feature to a single embodiment.

Reference will now be made to the following drawings, which assist in illustrating the various pertinent features of the various novel aspects of the present disclosure.

DETAILED DESCRIPTION

Figure 1:
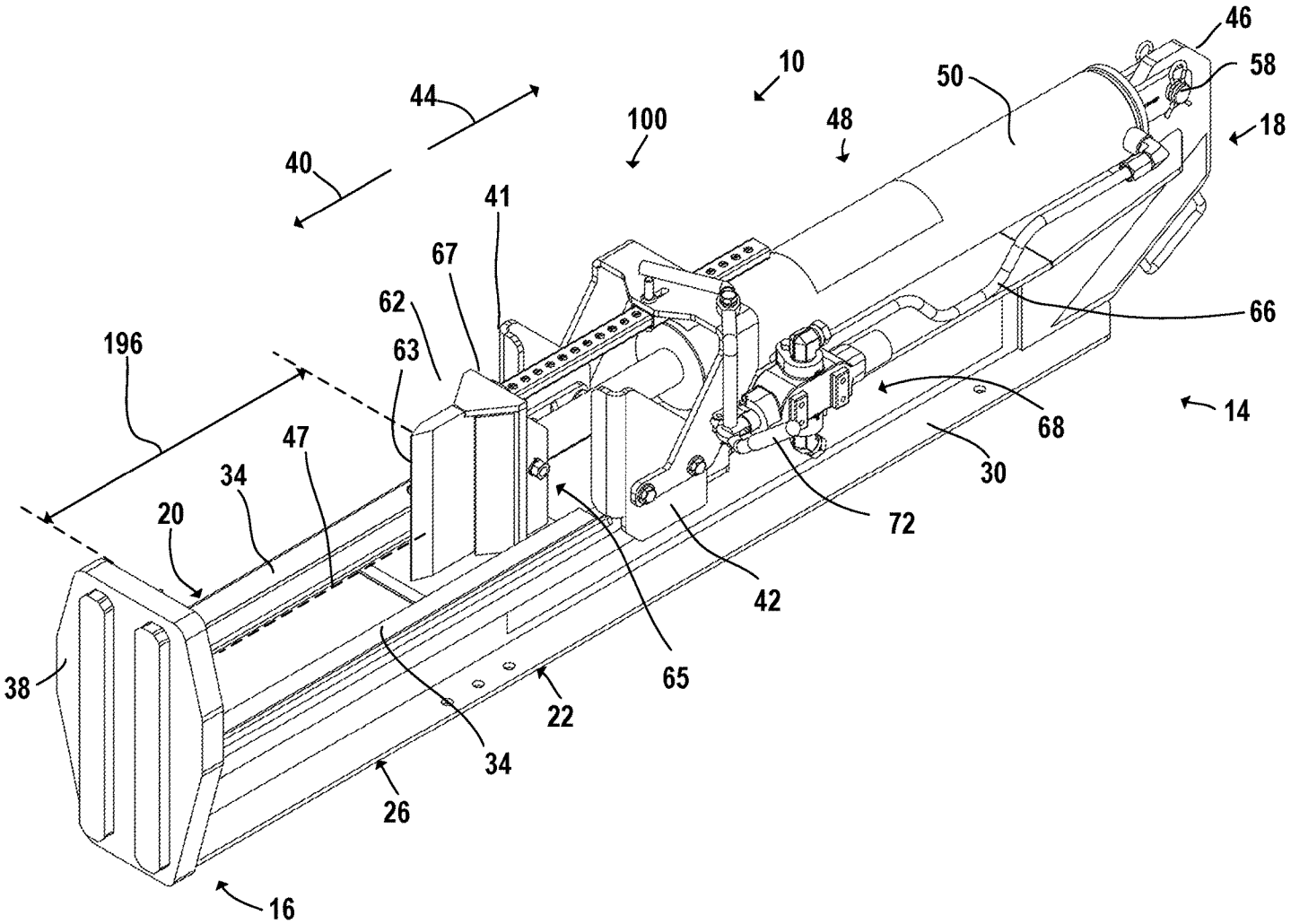
FIG. 1 is a front perspective view of a stroke reducing device being attached to a log splitting apparatus.
Figure 3:
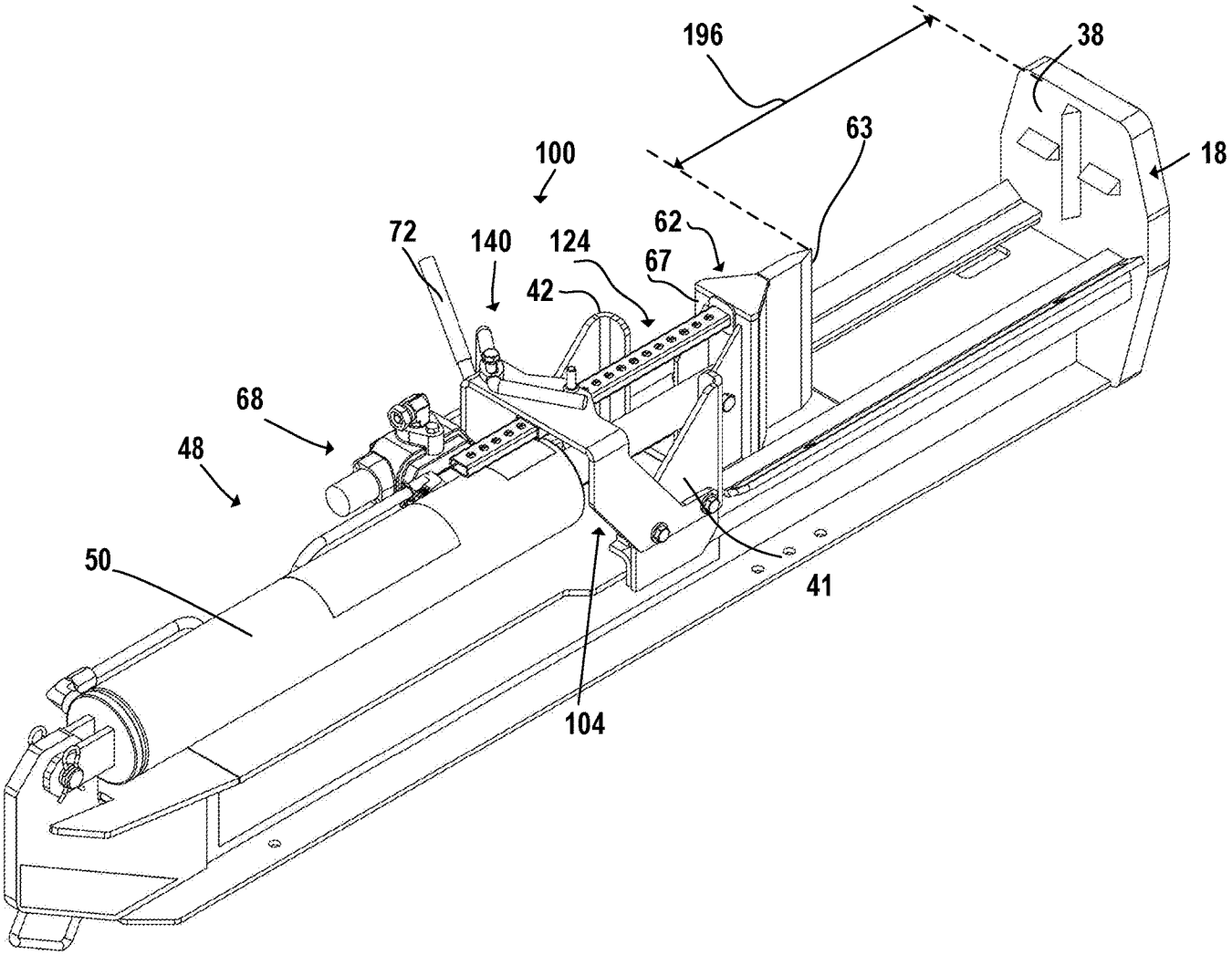
FIG. 3 is a rear perspective view of the stroke reducing device being attached to a log splitting apparatus of FIG. 1.
Figure 4:
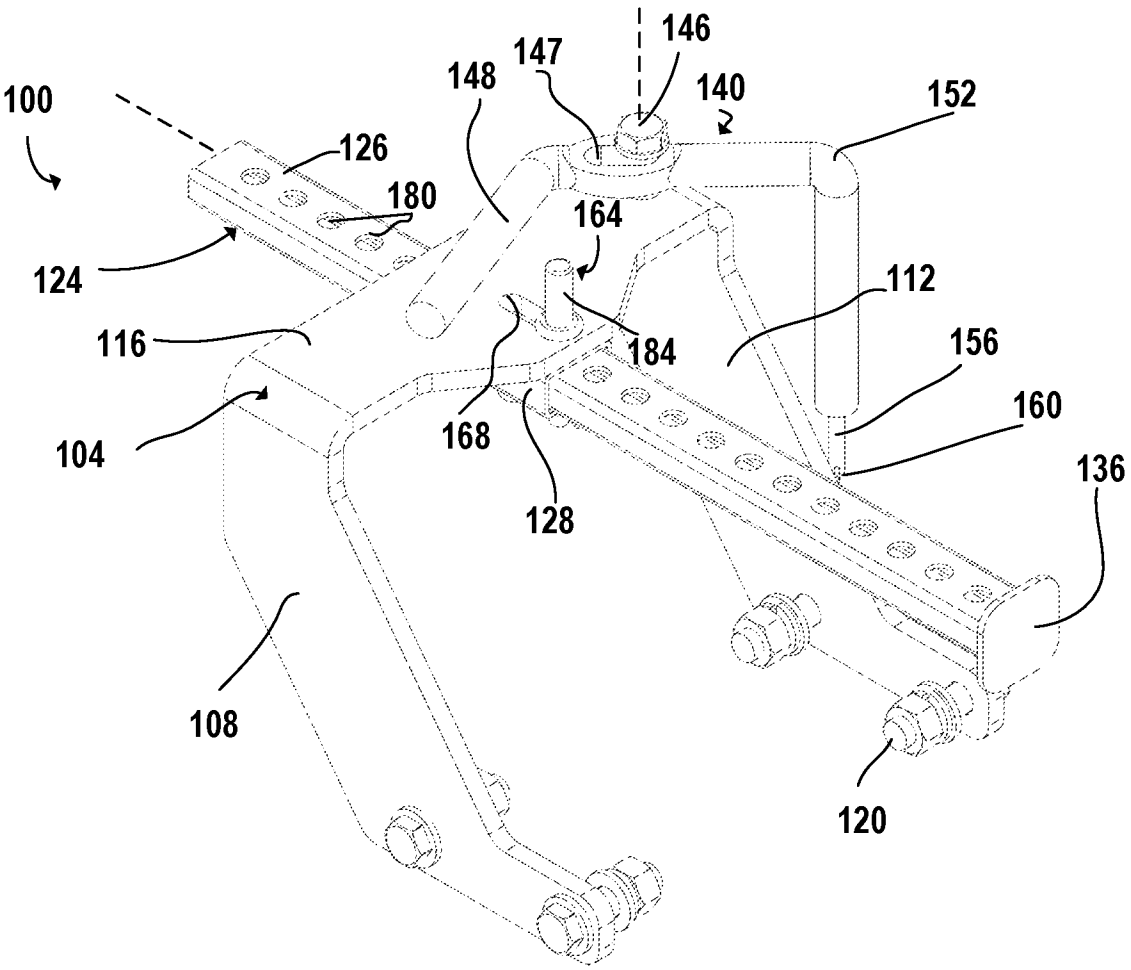
FIG. 4 is a front perspective view of the stroke reducing device of FIG. 1.
Figure 5:
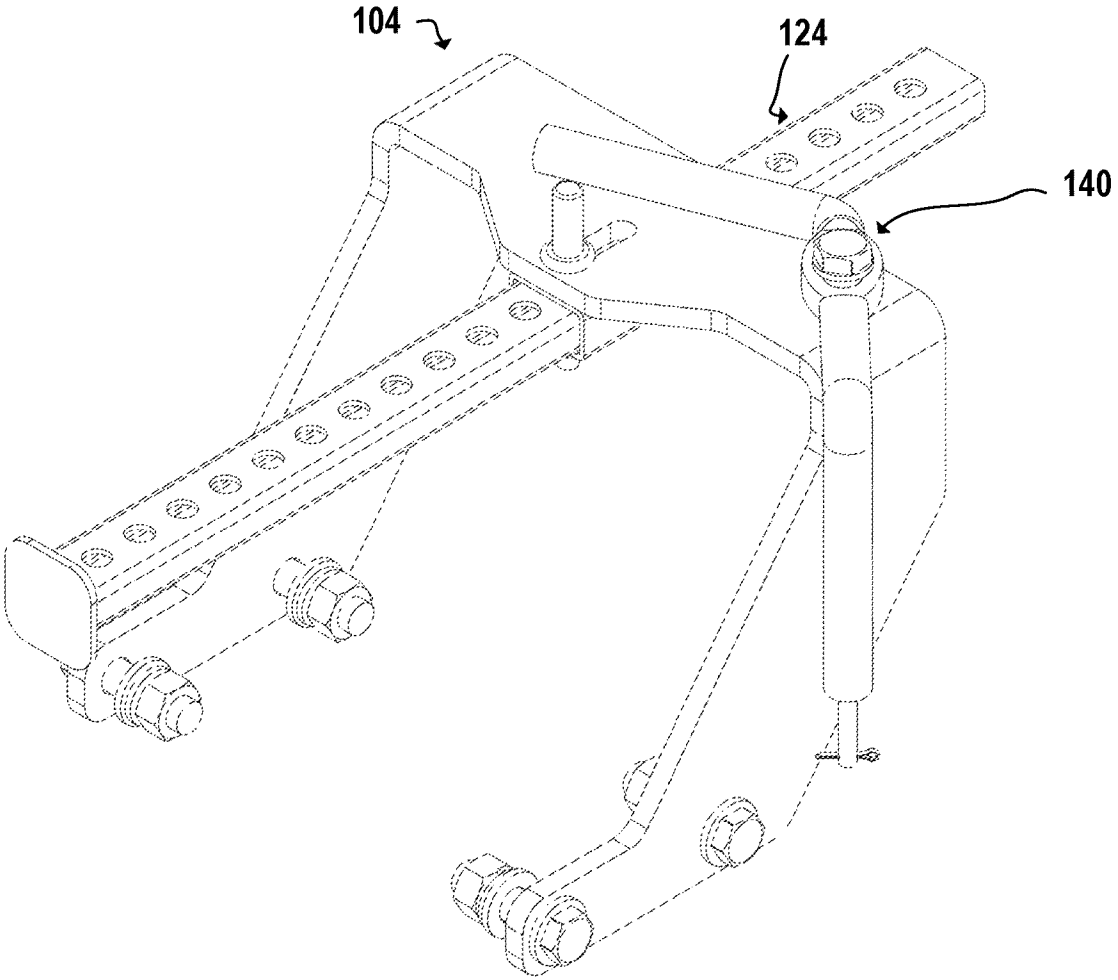
FIG. 5 is another front perspective view of the stroke reducing device of FIG. 1.
Figure 6:
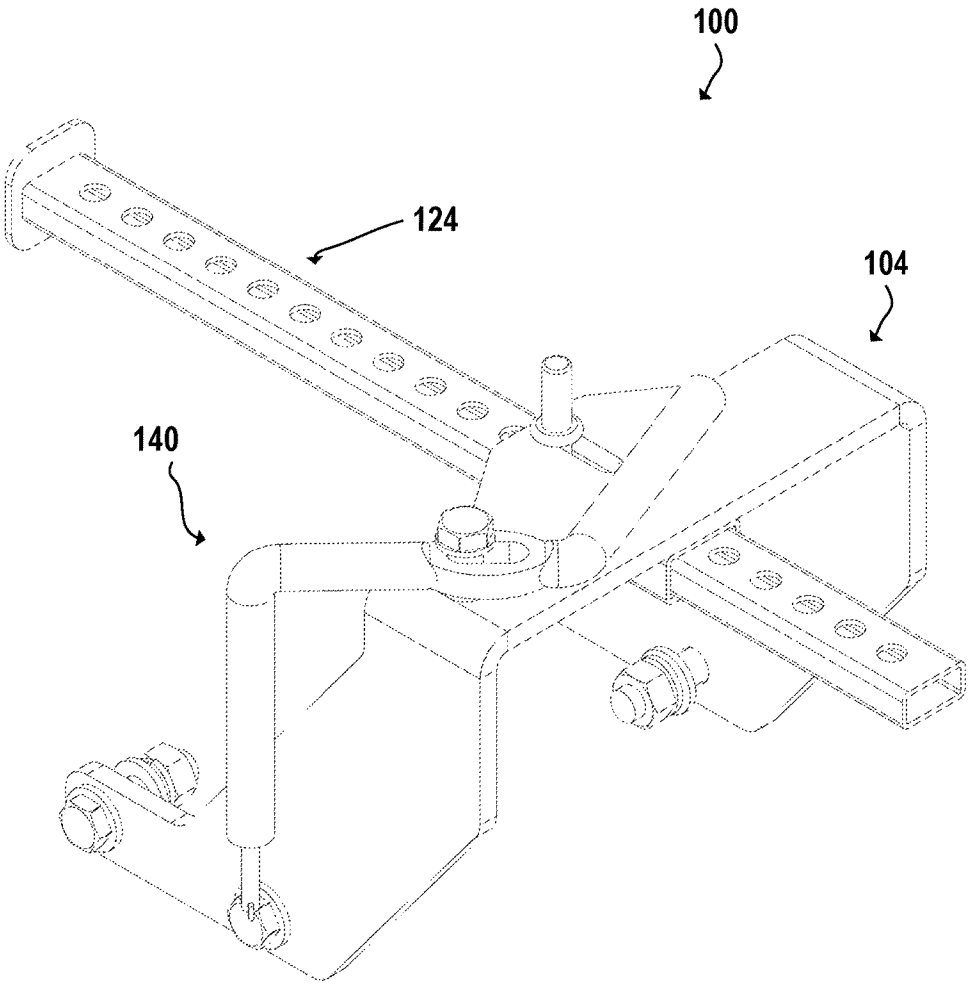
FIG. 6 is a rear perspective view of the stroke reducing device of FIG. 1.
Figure 7:
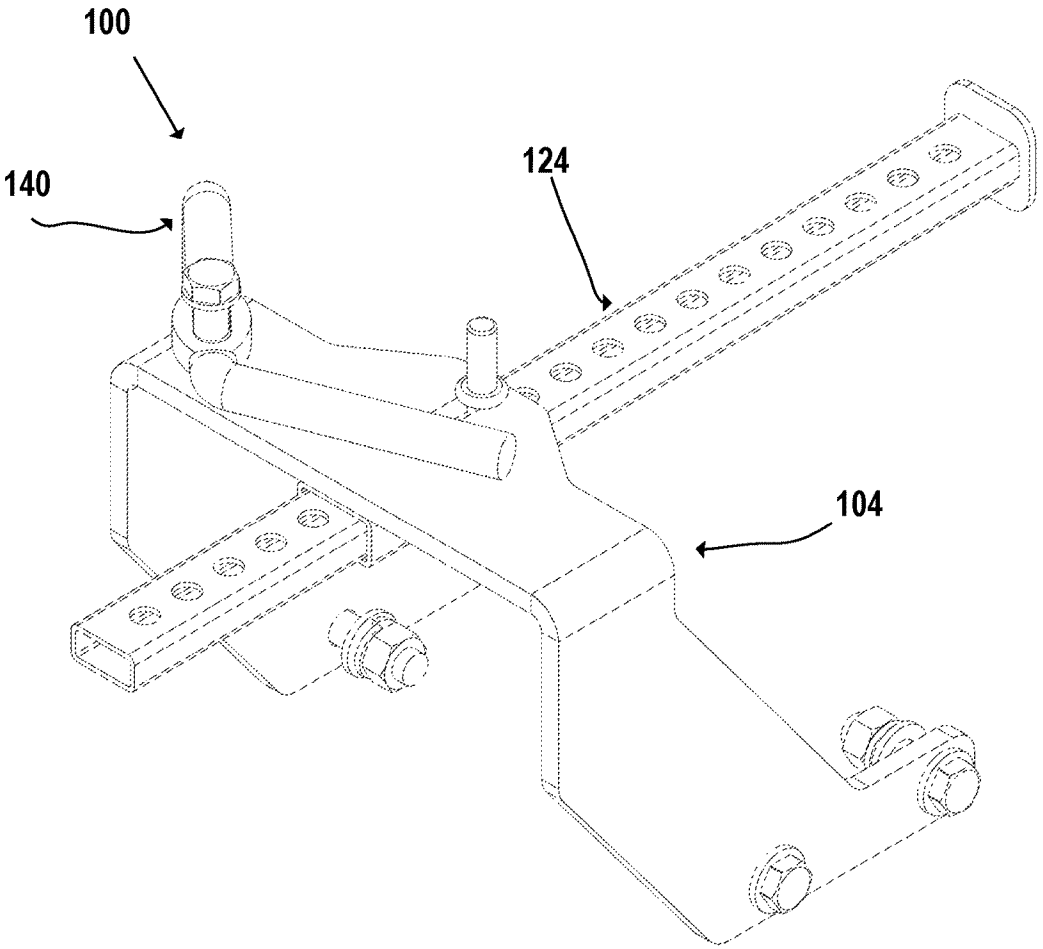
FIG. 7 is another rear perspective view of the stroke reducing device of FIG. 1.
Figure 8:
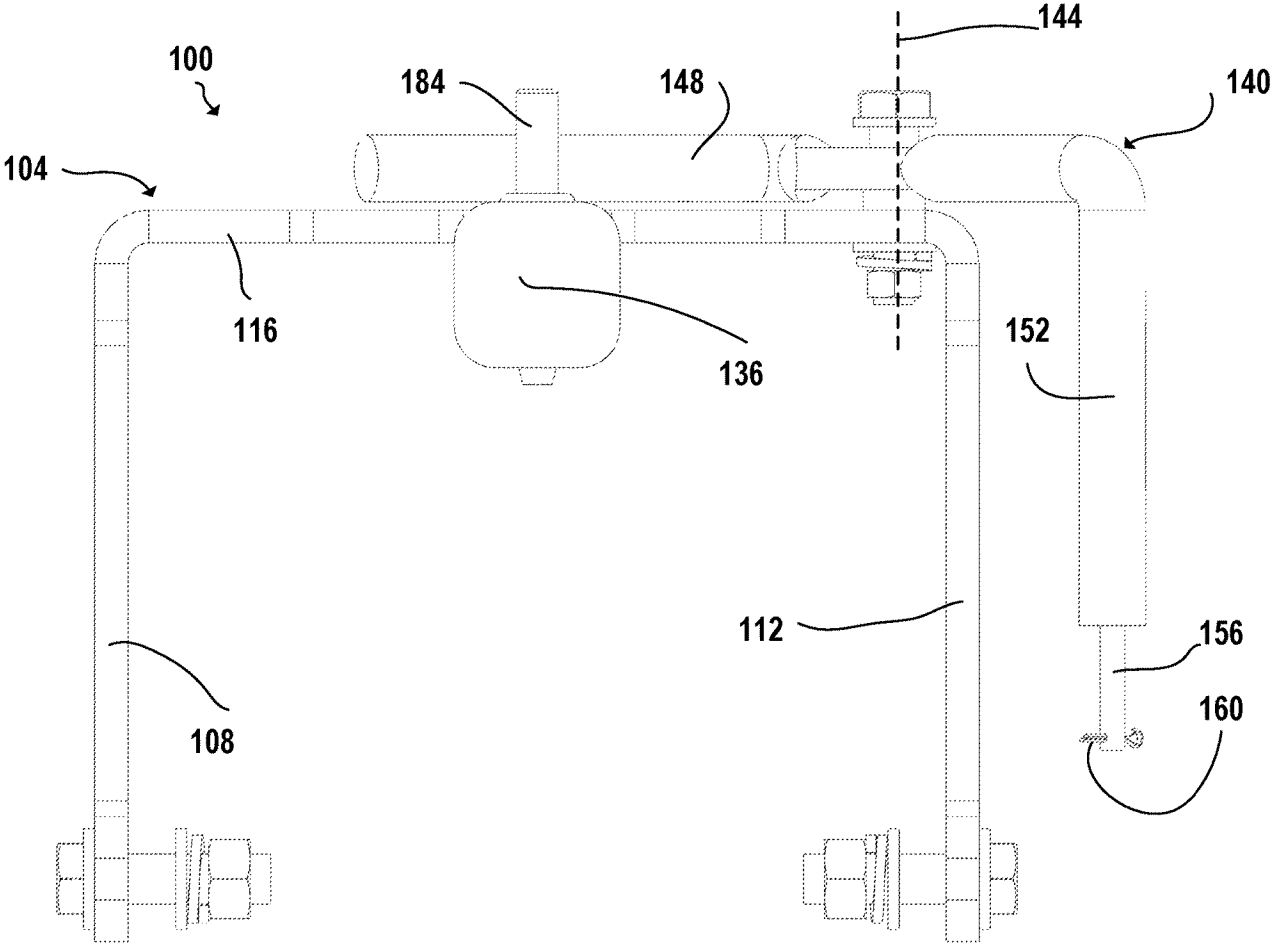
FIG. 8 is a front view of the stroke reducing device of FIG. 1.
Figure 9:
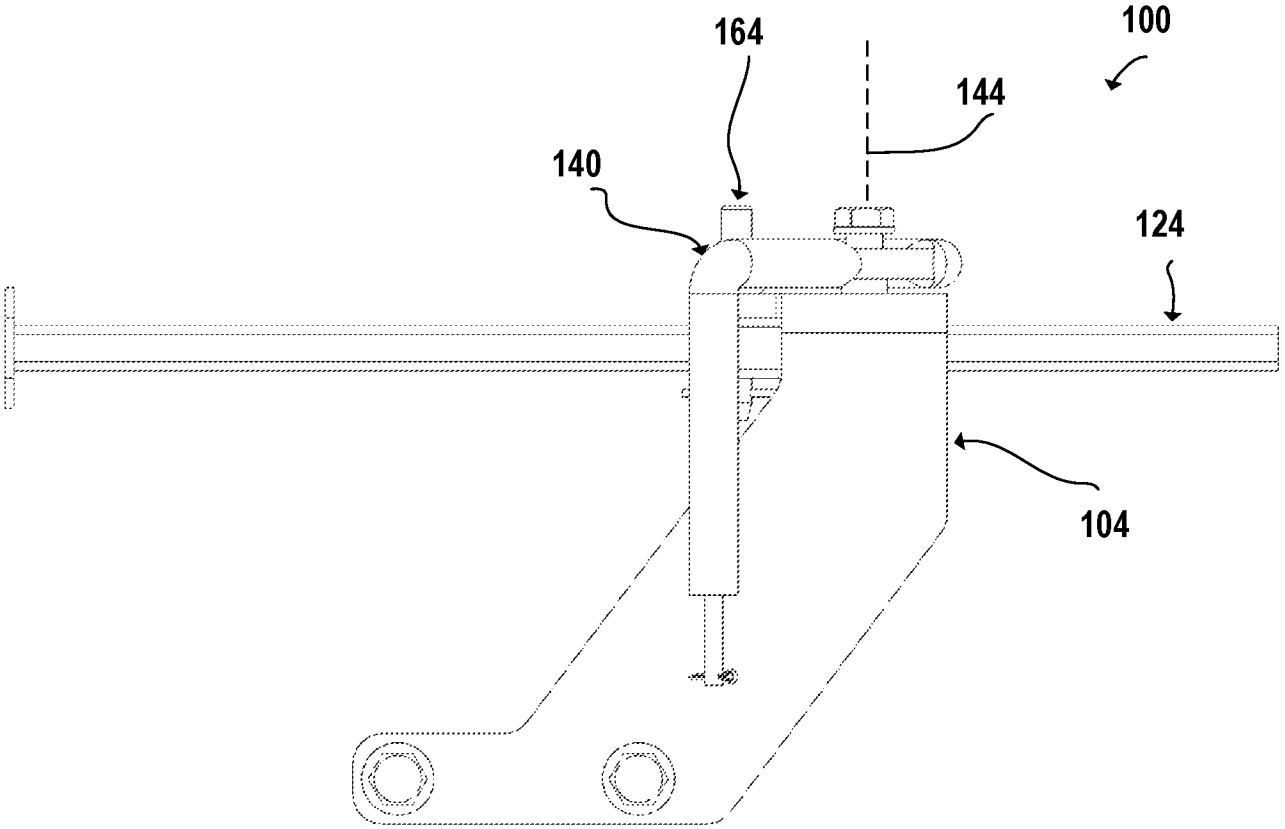
FIG. 9 is a right side view of the stroke reducing device of FIG. 1.
Figure 10:
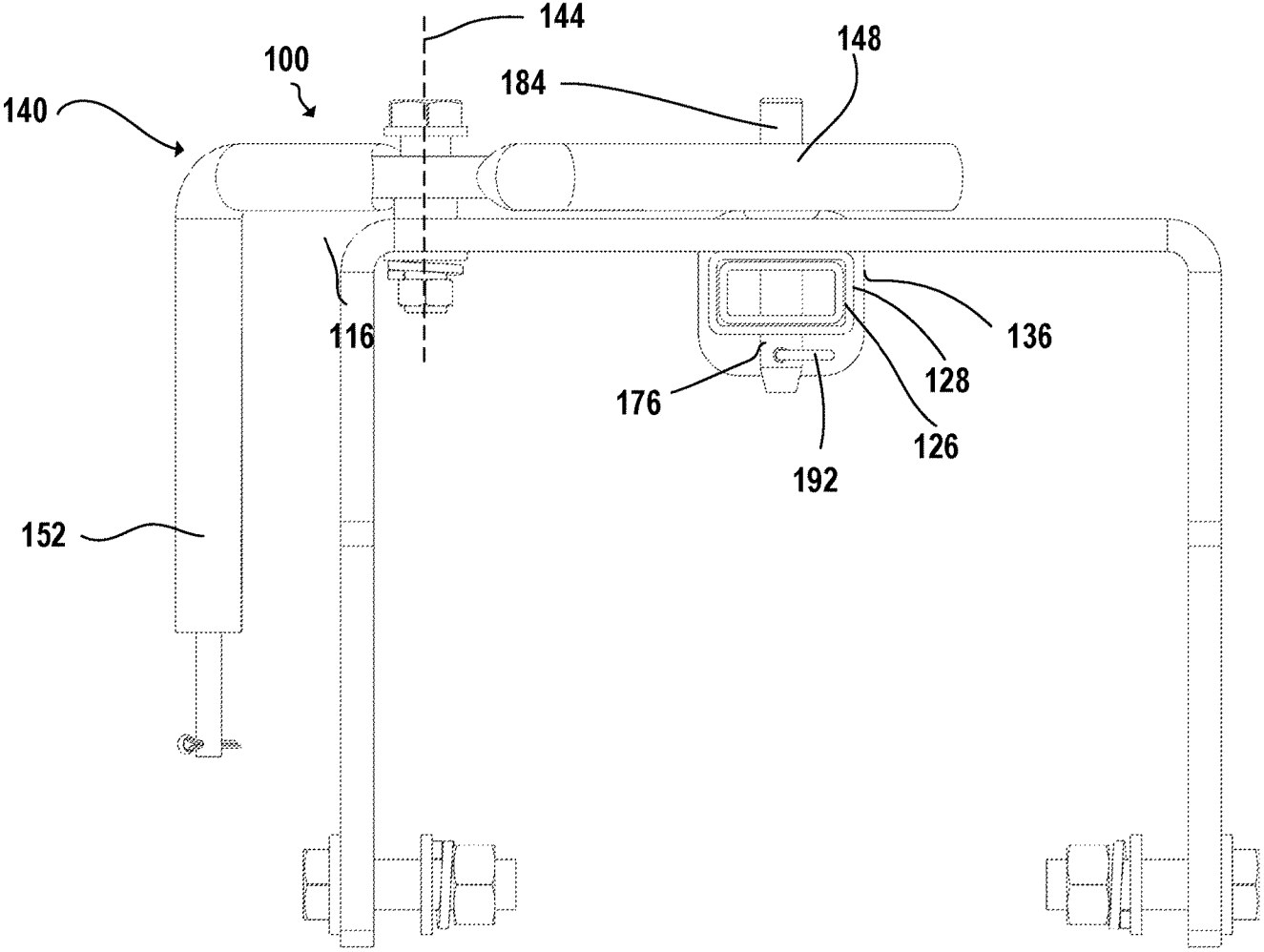
FIG. 10 is a rear view of the stroke reducing device of FIG. 1.
Figure 11:
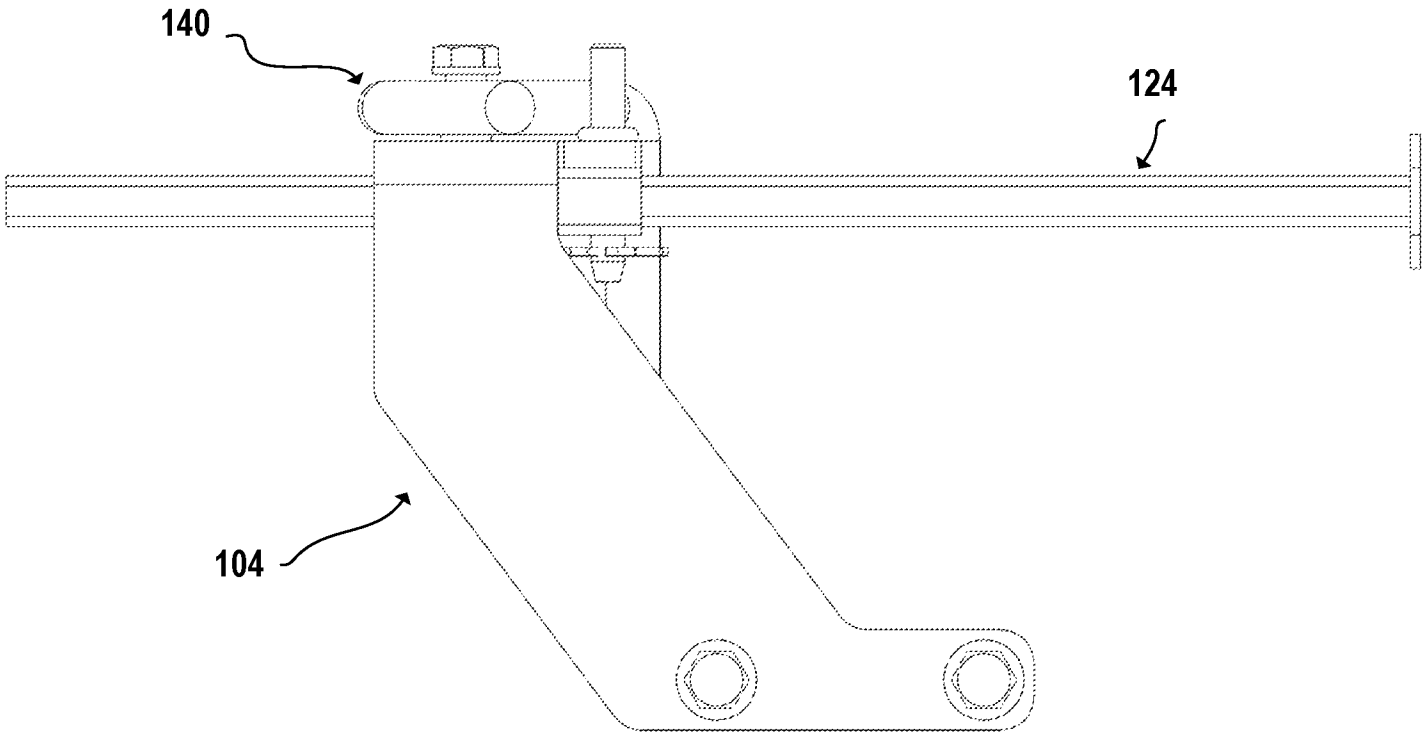
FIG. 11 is a left side view of the stroke reducing device of FIG. 1.
Figure 12:
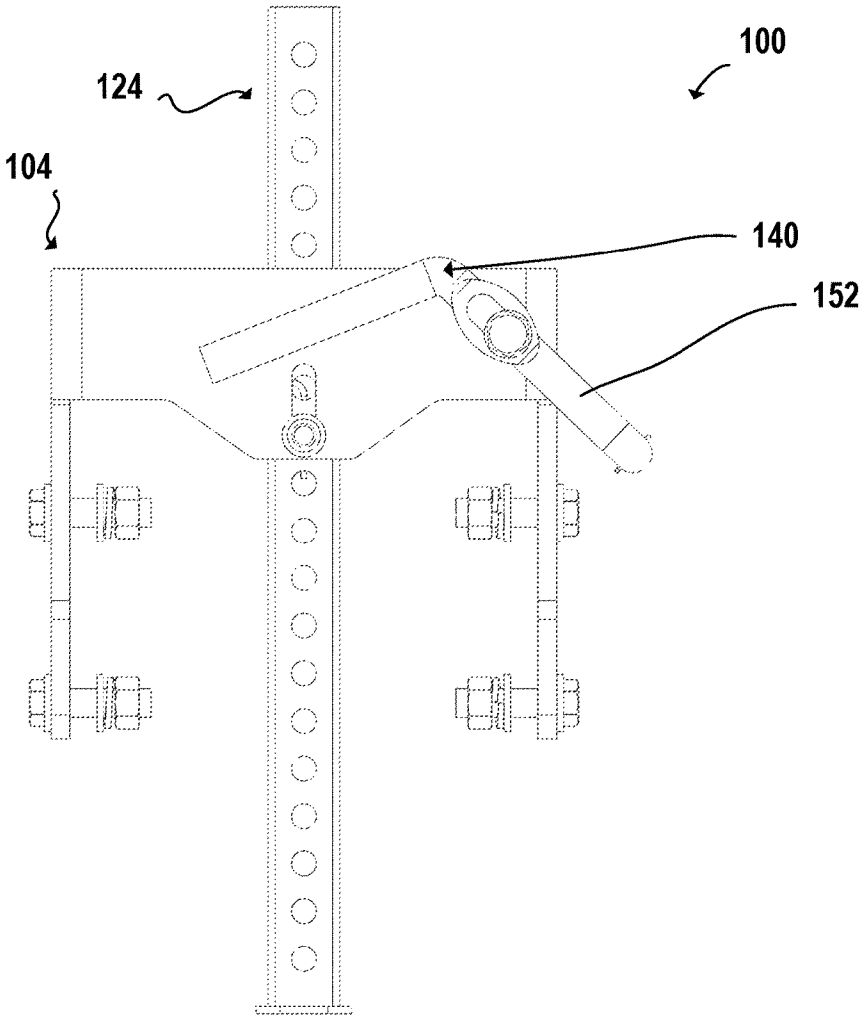
FIG. 12 is a top view of the stroke reducing device of FIG. 1.
Figure 13:
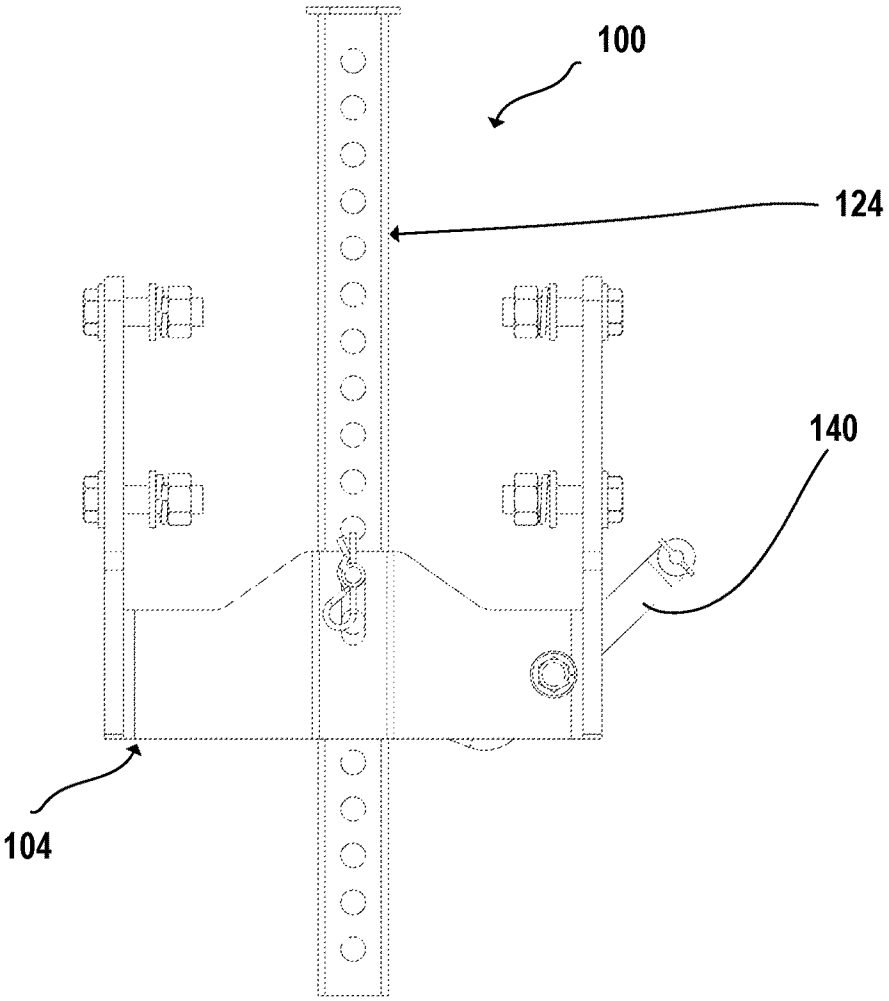
FIG. 13 is a bottom view of the stroke reducing device of FIG. 1.

FIGS. 1 and 3 present front and rear perspective views of a log splitting apparatus 10 broadly including a log splitter frame 14 for splitting logs (not shown) placed thereon. As shown, the log splitter frame 14 generally includes first and second opposite ends 16, 18, first and second opposite sides 20, 22, and opposite upper and lower portions 24, 26. In one arrangement, the log splitter frame 14 may be mountable onto a carriage (not shown) having a pair of wheels for supporting and facilitating transport of the frame. For instance, the log splitter frame 14 may be pivotally connected to the carriage via a pivot pin for pivotal movement of the log splitter frame 14 between at least first and second positions, such as horizontal and vertical positions.

The log splitter frame 14 may broadly include a support beam 30 such as an I-beam or the like (e.g., including first and second opposing ends, first and second opposing sides, and top and bottom opposing surfaces, not labeled), cradle members 34 (e.g., a pair of cradle members 34) appropriately secured or securable to the beam 30 and collectively forming a cradle for supporting at least one log (not shown) placed thereon or therebetween, a foot plate 38 secured or securable generally adjacent a first end of the cradle members 34 for providing an opposing force against a log placed on the cradle members 34 and being pushed against the foot plate 38 by a blade member 62 (e.g., including a single wedge for splitting a log in two, two wedges substantially perpendicular to each other for splitting a log in four, etc.), and at least one mounting bracket such as first and second mounting brackets 41, 42 secured (e.g., via welding) or removably securable (e.g., via bolt and nut assemblies) to or adjacent the first and second side portions 20, 22 of the frame 14 (e.g., such as on opposite sides of the beam 30 or cradle members 34) to facilitate mounting of a stroke reducing device 100 (discussed in more detail below) and/or to serve one or more other purposes. In one arrangement, the mounting brackets 42 may be in the form of stripper plates for stripping split logs from the blade member as the same is retracted (e.g., due to twisted grain and/or other inconsistencies in the logs) such as those disclosed in U.S. Pat. App. Pub. No. 2014/0124097 entitled "Log Splitting Apparatus Having Log Splitter Frame with Stripper Plates," assigned to the assignee of the present application and the entirety of which is incorporated herein by reference as if set forth in full.

The log splitting apparatus 10 also includes a drive assembly 48 for moving or advancing the blade member 62 in a first direction 40 towards the foot plate 38 to split a log placed on the cradle members 34 and in an opposite second direction 44 to retract the blade member 62 away from the split log and the foot plate 38 along a translation axis 47. For instance, the drive assembly 48 may include a linear actuator in the form of a cylinder 50 (e.g., hydraulic cylinder, etc.) secured to the log splitter frame 14 and a piston 64 to which the blade member 62 is secured that is configured to translate into and out of the cylinder 50 in the first and second opposite direction 40, 44 along the translation axis 47. While the figures illustrate the blade member 62 being attached to the piston 64 for linear movement towards and away from a foot plate 38 which is rigidly attached to the first end 16 of the frame 14, other arrangements encompassed herein include the foot plate 38 being attached to the piston 64 for linear movement towards and away from a blade member 62 which is rigidly attached to the first end 16 of the frame 14. In this regard, the "splitting assembly" 65 disclosed herein collectively indicates the piston 64 and one of the blade member 62 or foot plate 38 attached to the piston 64, where the splitting assembly 65 is linearly movable towards and away from the other of the blade member 62 or foot plate 38 to split a log. In one arrangement, the log splitter frame 14 may include an anchoring member such as an attachment lug 46 (e.g., part of the beam 30) to which an end of the cylinder 50 may be removably secured (e.g., via pin 58).

The drive assembly 48 also includes a triggering assembly 68 appropriately interconnected to the cylinder 50 as well as any other appropriate components of the drive assembly 48 that may be manipulated to trigger the splitting assembly 65 to advance in the first direction 40 or retract in the second direction 44. In the case of a hydraulic cylinder 50, the triggering assembly 68 may be in the form of a valve assembly that, when manipulated, forces hydraulic fluid (e.g., pumped from a reservoir by a fluid pump under power of a motor) through hydraulic lines 66 into one of first and second chambers (not shown) of the hydraulic cylinder 50 (and simultaneously out of the other of the first and second chambers) to correspondingly drive or advance the splitting assembly 65 in either the first direction 40 or the opposite second direction 44. For instance, a handle 72 (e.g., handle, switch, etc.) may be appropriately attached to the triggering assembly 68 to manipulate the same.

In one arrangement, the handle 72 may be pivotally attached (e.g., in any appropriate manner) to a portion of the triggering assembly 68 to pivot about a pivot axis 74 as well as substantially rigidly attached to a rod or shaft 76 of the triggering assembly 68 that is linearly translatable into and out of a housing 78 of the triggering assembly 68 along a translation axis 80 to effectuate flow of hydraulic fluid into or out of the first and second chambers of the cylinder 50 or to stop flow of hydraulic fluid into and out of the first and second chambers of the cylinder 50. For instance, when an operator manipulates the handle 72 about pivot axis 74 in a clockwise direction into a first position (not shown, but to the left of the position of handle 72 shown in FIG. 2*a*), the handle 72 simultaneously pulls the shaft 76 out of the housing 78 along translation axis 80 which opens a first fluid passageway through the hydraulic lines 66 to allow hydraulic fluid to be pumped into one of the first and second chambers of the hydraulic cylinder 50 and out of the other of the first and second chambers of the hydraulic cylinder 50 to drive the splitting assembly 65 in the first direction 40 into an extended position to split a log.

When the operator manipulates the handle 72 about pivot axis 74 in a counterclockwise direction into an intermediate position (e.g., as in FIG. 2*a*), the handle 72 simultaneously forces the shaft 76 into the housing 78 along translation axis 80 which closes the fluid passageways through the hydraulic lines 66 to stop hydraulic fluid from flowing into or out of both of the first and second chambers of the hydraulic cylinder 50 and thereby stop movement of the splitting assembly 65. Continued manipulation of the handle 72 about pivot axis 74 in a counterclockwise direction into a second position (e.g., opposite the first position, see FIG. 2*b*) simultaneously further forces the shaft 76 into the housing 78 along translation axis 80 which opens a second fluid passageway through the hydraulic lines 66 to allow hydraulic fluid to be pumped into the other of the first and second chambers of the hydraulic cylinder 50 and out of the one of the first and second chambers of the hydraulic cylinder 50 to retract the splitting assembly 65 in the second direction 44 towards the retracted position. From the second position of FIG. 2*a*, the operator may manipulate the handle 72 about pivot axis 74 in a clockwise direction back into the intermediate position of FIG. 2*a* to again stop movement of the splitting assembly 65.

One concern that can arise with existing log splitting devices is increased cycle times due to inefficient operation drive assembly of a log splitting device, especially when cutting logs whose length is increasingly shorter than the full stroke of the splitting assembly (e.g., where the full stroke may generally correspond to the distance between the first end 16 of the frame 14 and the mounting brackets 42 or the end of the cylinder 50). As discussed previously, operators often manipulate the handle or lever of the drive assembly to move the splitting assembly 65 into the fully retracted position, position the shorter log on the cradle, and then manipulate the handle to move the splitting assembly towards the log to split the same. However, the splitting assembly advances for at least a portion before the log begins splitting due to the shortened length of the log relative to the full stroke of the splitting assembly. Even if the user tries to carefully manipulate the handle or other triggering mechanism to stop the splitting assembly before it returns to the fully retracted position, doing so can be cumbersome in the case of many logs to be split and often requires the operator to manually "fine tune" the position of the splitting assembly before being able to mount the log on the cradle and split the same with the blade.

With additional reference now to FIGS. 4-13, the disclosed stroke reducing device 100 allows a user to adjust and limit the return or retraction stroke of the splitting assembly 65 (e.g., limit movement of splitting assembly 65 in the second direction 44 of FIG. 1) to be just slightly larger than the length or other dimension of wood to be cut free of the user having to manually manipulate the trigging mechanism 68 (e.g., via handle 72) to achieve such a reduced retraction stroke. That is, the disclosed stroke reducing device 100 allows a user to, after splitting a log, appropriately manipulate the trigging mechanism 68 (e.g., by moving handle 72 into the second position as shown in FIG. 2*b*) to induce initial retraction of the splitting assembly 65 in the second direction 44 without having to manually manipulate the triggering mechanism 68 to stop the splitting assembly 65 at a position short of a fully retracted position. As the splitting assembly 65 automatically stops short of a full retraction stroke, the splitting assembly 65 is thus automatically configured to split a log in less than a full advancement stroke thereby limiting the degree of advancement of the splitting assembly 65 before splitting of a log begins.

Broadly, the stroke reducing device 100 includes an anchoring member 104 that is rigidly (e.g., non-movably) secured to the log splitter frame 14 as well as at least one mechanical link that is movably secured to the anchoring member 104 that mechanically deactivates the drive assembly 48 to limit further retraction of the splitting assembly 65 upon receipt by the at least one mechanical link of a force from the splitting assembly 65 moving in the second direction 44. As an example, the anchoring member 104 may be in the form of one or more brackets such as a first leg 108 that is rigidly (i.e., non-movably) securable to the first side portion 20 of the frame 14, a second leg 112 that is rigidly (i.e., non-movably) securable to the second side portion 20 of the frame 14, and a base member or platform 116 that rigidly interconnects the first and second legs 108, 112. The term "platform" does not necessarily connote a flat or planar member; rather, it may be any appropriate bracket or the like to which the at least one mechanical link may be movably securable as discussed below.

For instance, the platform 116 may extend over the cylinder 50 and/or piston 64 across the upper portion 24 of the frame 14 while the first and second legs 108, 112, may extend downwardly from opposite first and second ends (not labeled) of the platform 116 towards the first and second side portions 20, 22 of the frame 14. In one arrangement, a number of fastening assemblies 120 (e.g., each including a bolt, washer, nut, etc.) may be used to rigidly secure the first and second legs 108, 112 to the first and second mounting brackets 41, 42 of the frame 14. As shown, the platform 116 may, in one embodiment, be set back in the second direction 44 from where the first and second legs 108, 112 attach to the first and second mounting brackets 41, 42 (or other portions of the first and second side portions 20, 22 of the frame 14) to increase the range of adjustability of the stroke of the splitting assembly 65 as will be discussed in more detail below.

Figure 14:
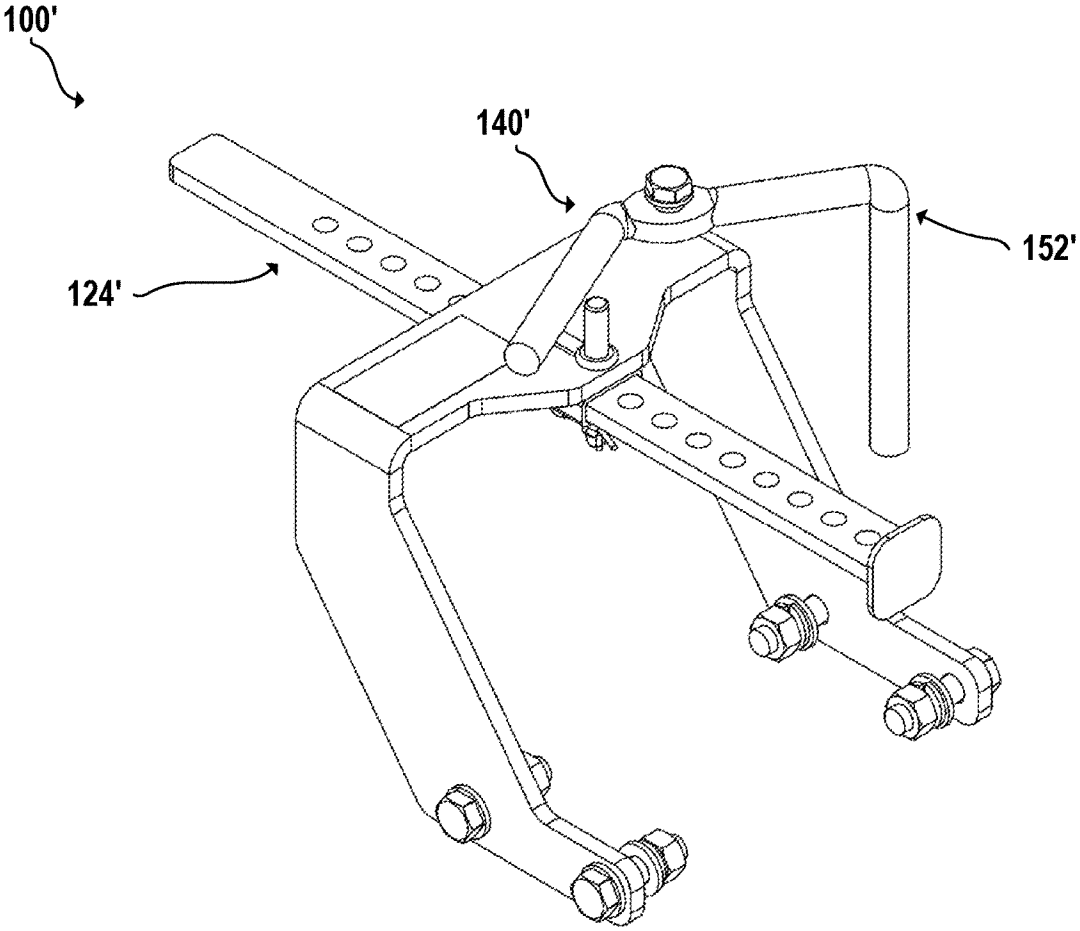
FIG. 14 is a front perspective view of the stroke reducing device similar to that in FIG. 4, but according to another embodiment.
Figure 15:
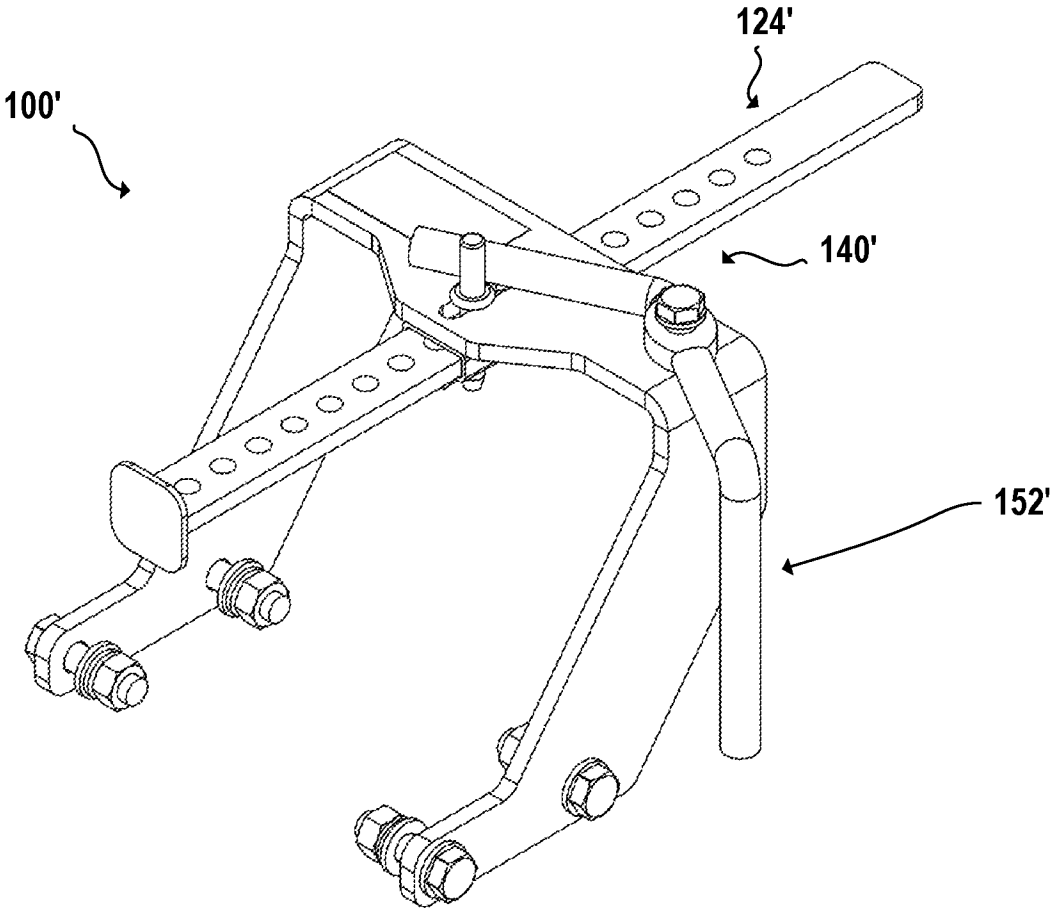
FIG. 15 is a front perspective view of the stroke reducing device similar to that in FIG. 5, but according to the embodiment of FIG. 14.
Figure 16:
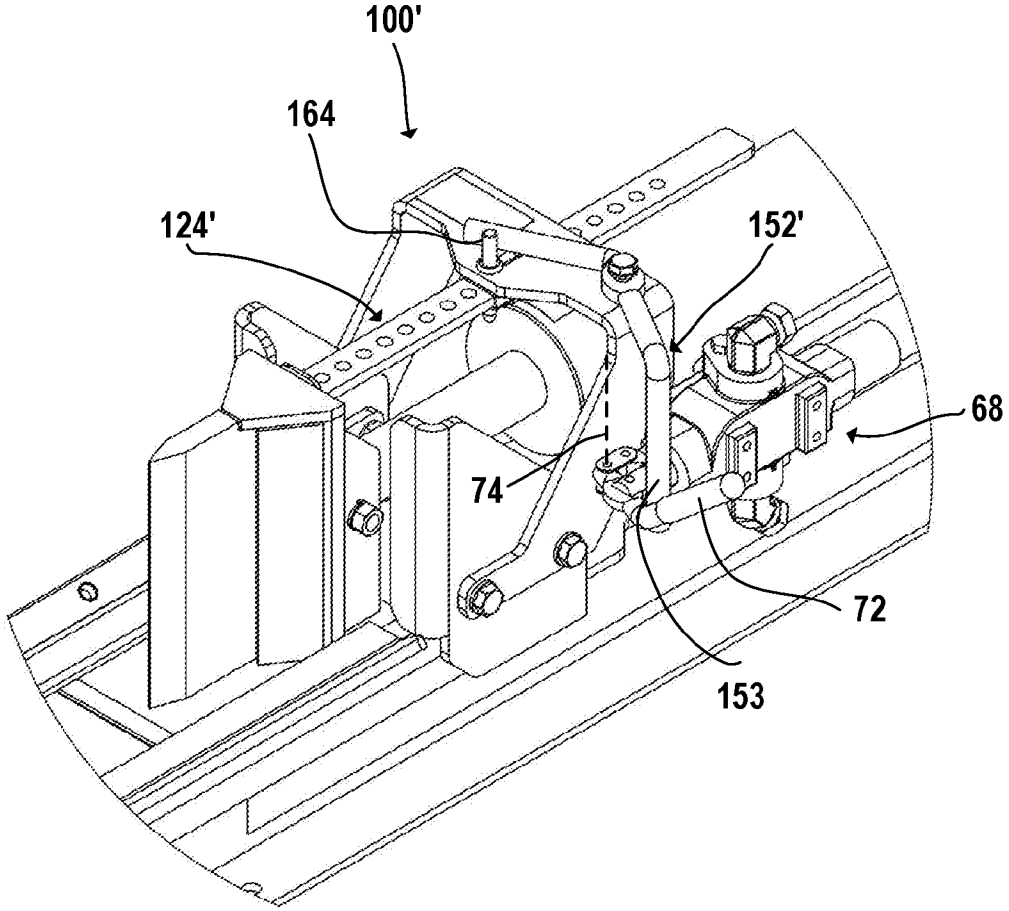
FIG. 16 is a close-up perspective view similar to that in FIG. 2*b*, but with the stroke reducing device according to the embodiment of FIG. 14.

The at least one mechanical link of the stroke reducing device 100 may include at least a first mechanical link 124 (e.g., rigid bracket, member or plate) that is movably securable to the platform 116 and that is configured to receive a force from the splitting assembly 65 (e.g., from a rear 67 of the blade member 62 or a rear of the foot plate 38 when the foot plate 38 is attached to the piston 64) as the splitting assembly 65 is being retracted by the drive assembly 48 in the second direction 44. For example, the first mechanical link 124 may be in the form a sliding member such as an elongated rod 126 that is configured to translate (e.g. slide, telescope) into or out of a slot or passageway 128 of or attached to the platform 116 along a translation axis 132 (e.g., that is parallel to the translation axis 47 along which the splitting assembly 65 translates). While the elongated rod 126 is illustrated in some embodiments as being in the form of a rigid tubular member, the elongated rod 126 may be a substantially solid member in other embodiments (e.g., see embodiment of FIGS. 14-16). In one arrangement, the mechanical link 124 may include a force receiving member 136 (e.g., bracket, plate) rigidly attached to an end thereof to receive a contact and force from a rear portion 67 of the blade member 62 as the splitting assembly 65 is being retracted in the second direction 44.

The stroke reducing device 100 may also include a second mechanical link 140 (e.g., rigid bracket or member) that is movably securable to the platform 116 and that is attachable to the triggering assembly 68 (e.g., to handle 72 and/or shaft 76). The first and second mechanical links 124, 140 are movably positioned on the platform 116 and relative to each other in a manner so that upon receipt by the first mechanical link 124 of the force from the splitting assembly moving in the second direction, the first mechanical link 124 simultaneously induces the second mechanical link to move relative to the anchoring member 116 to manipulate the triggering assembly 68 to deactivate the drive assembly 48 and inhibit further retraction of the splitting assembly 65 in the second direction 44.

In one arrangement, the second mechanical link 140 may be in the form of a bracket or member that is pivotally attached to the platform 116 about a pivot axis 144 by a pivot pin 146 (e.g., bolt and nut assembly) or the like that extends through an aperture 147 (see FIGS. 2*d*, 4 and 6) through the second mechanical link 140 and an aperture through the platform 116 of the anchoring member 104 (e.g., where the pivot axis 144 may, in one embodiment, be substantially perpendicular to the translation axis 132). In one arrangement, the aperture 147 through the second mechanical link 140 may be in the form of a slot to allow the second mechanical 140 to slightly translate or slide as it pivots about the pivot axis 144. In another arrangement, the aperture 147 may be in the form of a substantially circular hole (e.g., as in the embodiment of FIGS. 14-16). In one embodiment, one or more bushings or the like may be disposed adjacent the aperture 147.

The second mechanical link 140 may have a first portion or arm 148 on a first side of the pivot axis 144 that is configured to be contacted and forced in one of a clockwise or counterclockwise direction (e.g., as shown, in a clockwise direction) by the first mechanical link 124 upon receipt of the force from the splitting assembly 65. Furthermore, the second mechanical link 140 may also have a second portion or arm 152 on an opposite second side of the pivot axis 144 (and rigidly or non-movably attached to the first arm 148) that is configured to move in the one of the clockwise or counterclockwise direction (e.g., as shown, in the clockwise direction) as the first arm 148 is doing so to manipulate the triggering assembly 68 to deactivate the drive assembly. In other words, the first mechanical link 124 of the stroke reducing device 100 uses the force of the splitting assembly 65 moving in the second direction 44 to apply a torque to the second mechanical link 140 to manipulate the triggering assembly 68 in a manner that inhibits further movement of the splitting assembly 65 in the second direction 44. In one arrangement, the pivot axis 144 may be substantially parallel to the pivot axis 74 of the handle 72 and substantially perpendicular to the translation axis 80 of the shaft 76 of the triggering assembly 68.

The second arm 152 of the second mechanical link 140 may be configured to contact the triggering assembly 68 to manipulate the same in any appropriate manner. In one arrangement, the second arm 152 may include a shaft or rod 156 rigidly attached thereto that is configured to be received in a correspondingly shaped aperture (not labeled) through the handle 72 and/or shaft 76 of the triggering assembly 68 such that movement of the second arm 152 about the pivot axis 144 simultaneously induces movement of the shaft 76 along translation axis 80 as discussed in more detail below. For instance, after an end of the rod 156 has been passed through the aperture of the handle 72 and/or shaft 76, a locking pin 160 may be passed through a locking hole of the rod 156 to limit unintentional removal of the rod 156 from the aperture of the handle 72 and/or shaft 76. It is to be understood, however, that numerous other manners of attaching the second arm 152 to the triggering assembly 68 are also envisioned and encompassed herein (e.g., clips, bolts, etc.).

To facilitate the automatic deactivation of the drive assembly 68 during retraction of the splitting assembly 65 to limit a full return or retraction stroke of the splitting assembly 65, it may be important to limit or restrict movement of the first mechanical link 124 (e.g., along translation axis 132) to a distance that manipulates the triggering assembly 68 just into a position that deactivates the drive assembly 48 but does not allow the triggering assembly 68 to be further manipulated into a position that reactivates the drive assembly 48 absent manual manipulation of the triggering assembly 68 (e.g., of the handle 72) by an operator. As just one example, the first mechanical link 124 may further include a restriction member 164 that is rigidly attachable to the elongated rod 126 and that is configured to be received and slidably travel in a passageway or slot 168 of the platform 116 as the elongated rod 126 slides in the passageway 128 (e.g., where the restriction member may be considered a "sliding member").

Figure 2A:
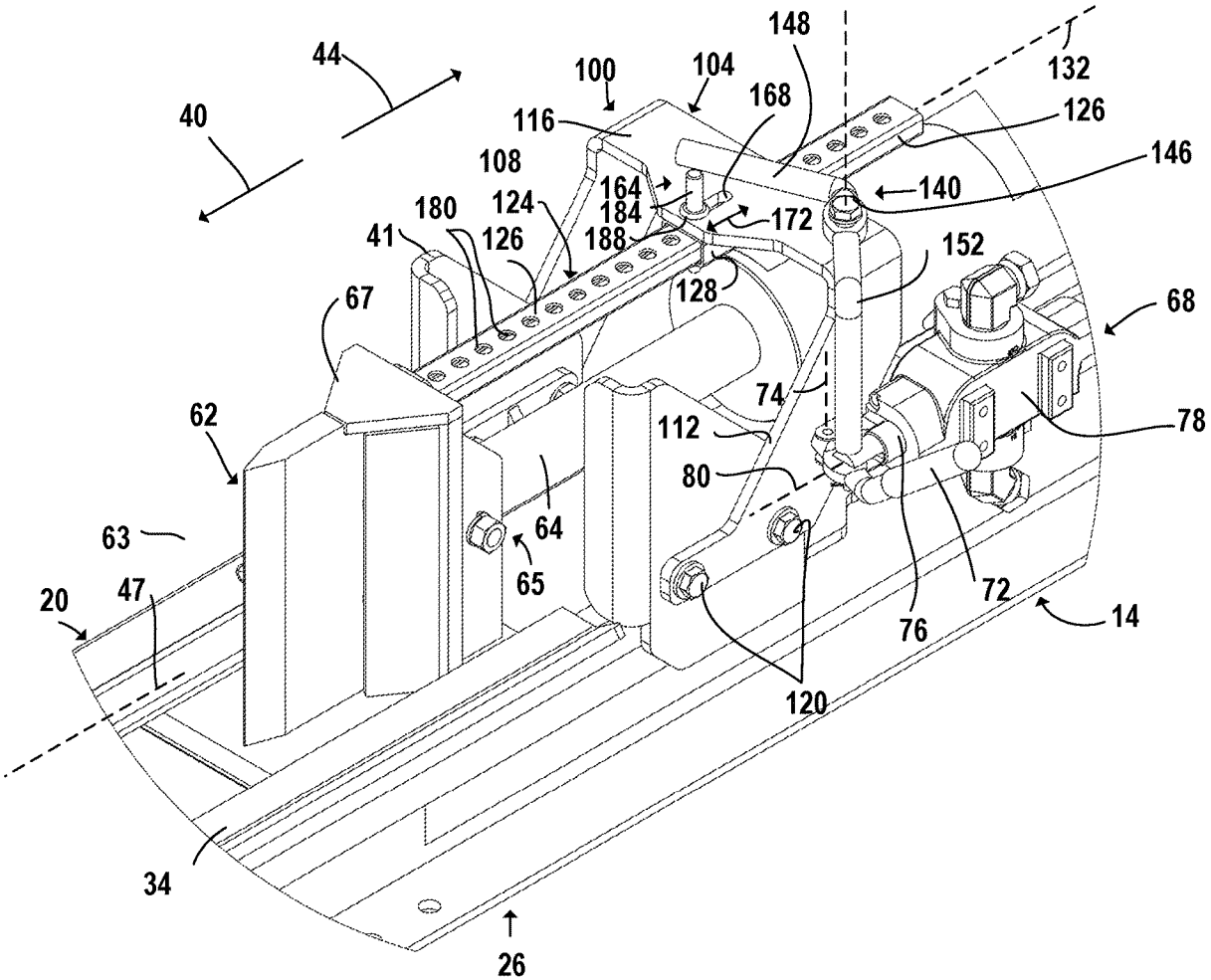
FIG. 2*a* is close-up perspective view of the stroke reducing device attached to the log splitting apparatus of FIG. 1.
Figure 2B:
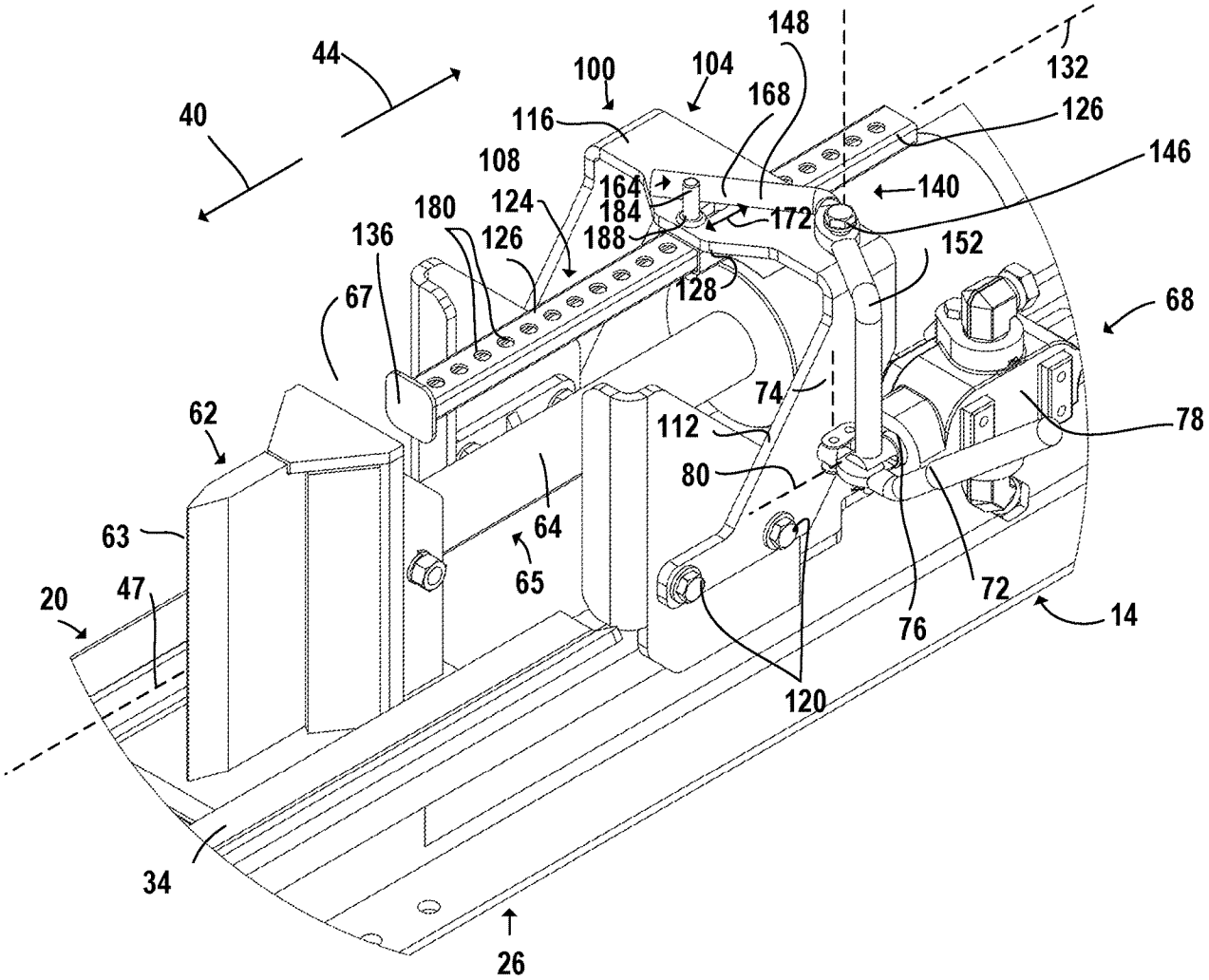
FIG. 2*b* is a close-up perspective view similar to FIG. 2*a* but with the blade member separated from the stroke reducing device and a handle of a triggering assembly being moved into a second position to retract the blade member towards the stroke reducing device.

Specifically, the slot 168 may have a length 172 that is chosen to restrict translation of the elongated rod 126 along translation axis 132 in the second direction 44 to an amount that torques the second mechanical link 140 by an amount just necessary to move the handle 72 and shaft 76 from the second position shown in FIG. 2*b* to the intermediate position shown in FIG. 2*a* which stops movement of the splitting assembly 65. In one arrangement, the restriction member 164 may also be the portion of the first mechanical link 124 that contacts the first arm 148 of the second mechanical link 140 to torque the same about pivot axis 144. As an example, the restriction member 164 may be in the form of a rod or shaft having a first portion 176 that is receivable through the slot 168 as well as one of a series of apertures 180 formed through the elongated rod 126, and an opposite second portion 184 that protrudes away from the slot 168 and that is configured to contact the first arm 148 of the second mechanical link 140.

A rib 188 or the like may generally separate the first and second portions 176, 184 and may be configured to rest on the top surface of the platform 116 to limit passage of the second portion 184 through the slot 168. For instance, the rib 188 may have an outer diameter that is greater than a width of the slot 168. To limit unintentional removal of the first portion 176 of the restriction member 164 from the slot 168 and aperture 180 of the elongated rod 126, a locking pin 192 may be passed through a locking hole in the second portion 184 of the restriction member. It is to be understood, however, that numerous other manners of limiting unintentional removal of the first portion 176 of the restriction member 164 from the slot 168 and aperture 180 of the elongated rod 126 are also envisioned and encompassed herein.

To facilitate the reader's understanding of the functionalities of the stroke reducing device 100, one manner of operation of the stroke reducing device will now be discussed although it is to be understood that other manners of operation are also envisioned and included herein. For instance, one step may include removing the restriction member 164 from the aperture 180 of the elongated rod 126 and the slot 168 of the platform 116 (e.g., which may initially require removing locking pin 192 from the first portion 176 of the restriction member 164) and then sliding elongated rod 126 within passageway 128 of platform 116 to a position so that upon contact of the force receiving member 136 (or end of elongated rod 126) by the splitting assembly 65 (e.g., rear portion 67 of blade member 62 or a rear of the foot plate 38 when the foot plate 38 is attached to the piston 64), a distance 196 between front portion 63 of blade member 62 and a front portion of the foot plate 38 is approximately equal to (e.g., just larger than) a length of a log or piece of wood to be cut. With the elongated rod 126 in the above-noted position, the first portion 176 of the restriction member 164 may be inserted back through the slot 168 in the platform 116 and one of the apertures 180 overlapping the slot 168 (e.g., and the locking pin 192 may be inserted back through the first portion 176 of the restriction member 164) to against restrict sliding movement of the first mechanical link 124 to a distance approximately equal to (e.g., slightly less than) the length 172 of the slot 168.

A log may then be placed between the foot plate 38 and the blade member 62 over the cradle members 34 of the frame 14 and the drive assembly 48 operated to drive the splitting assembly 65 in the first direction 40 (away from the first mechanical link 124) to split the log with the front portion 63 of the blade member 62 and the front portion of the foot plate 38. For instance, from the intermediate position of the handle 72 illustrated in FIG. 2*a* in which the splitting assembly 65 is stopped, an operator may manipulate the handle 72 into the first position (e.g., in a clockwise direction about pivot axis 74 from position shown in FIG. 2*a*) to pull the shaft 76 out of the housing 78 of the triggering assembly 68 and thereby open the first fluid passageway through the triggering assembly 68 that advances the splitting assembly 65 in the first direction 40.

After the log has been split, the operator may then manipulate handle 72 into the second position of FIG. 2*b* (e.g., in a counterclockwise direction about pivot axis 74) to push the shaft 76 into the housing 78 of the triggering assembly 68 and thereby open the second fluid passageway through the triggering assembly 68 that retracts the splitting assembly 65 in the second direction 40. With reference to FIG. 2*b*, it can be seen how manipulation of the handle 72 into the second position in the counterclockwise direction about pivot axis 74 simultaneously urges the second mechanical link 140 in the counterclockwise direction about pivot axis 144 to position the second arm 148 in contact with or adjacent the second portion 184 of the restriction device 164 (so that the second arm 148 at least intersects the range of travel of the second portion 184 along the slot 168).

Figure 2C:
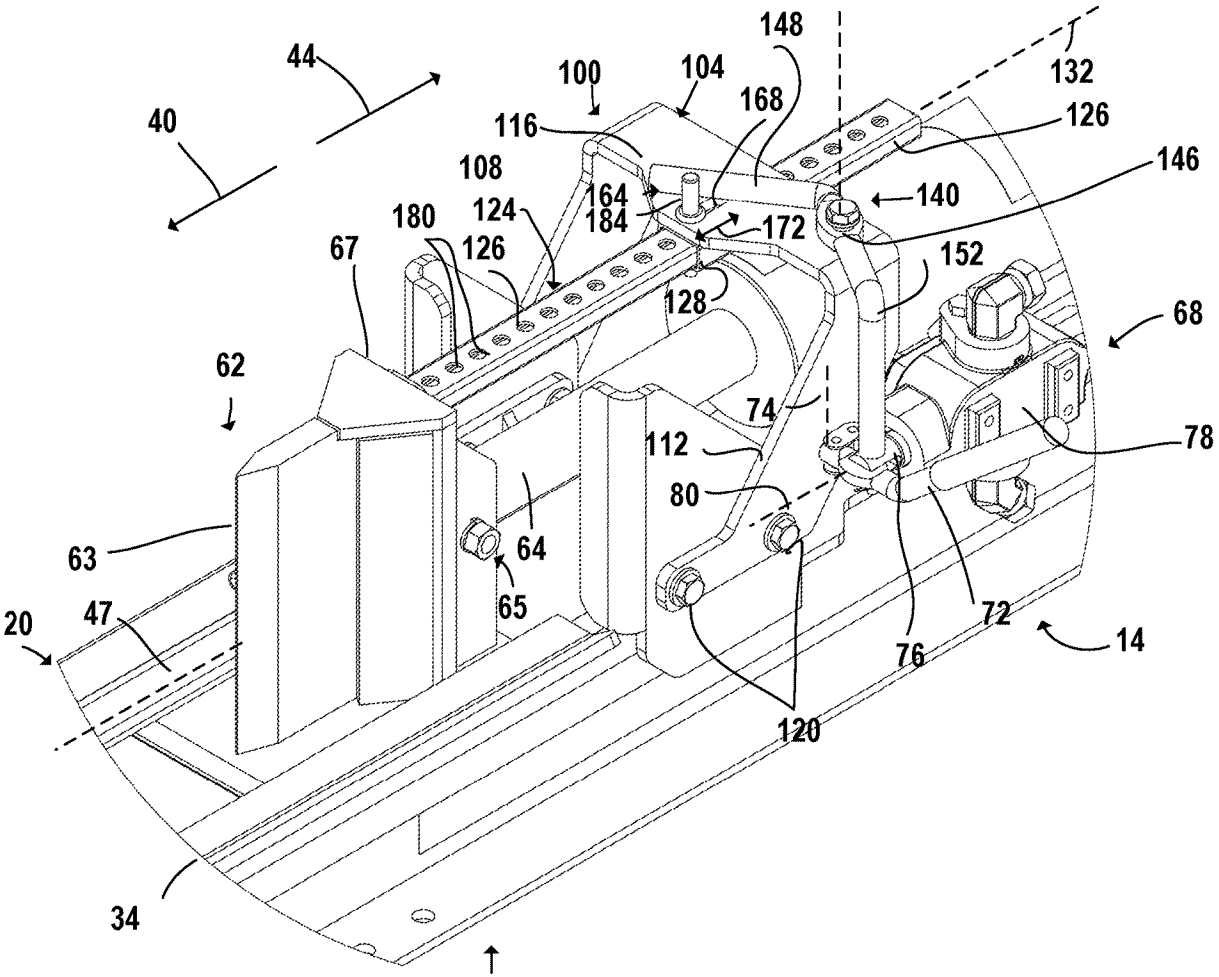
FIG. 2*c* is a close-up perspective view similar to FIG. 2*b* but with the blade member having moved into contact with a first mechanical link of the stroke reducing device and the first mechanical link having moved into contact with a second mechanical link of the stroke reducing device.
Figure 2D:
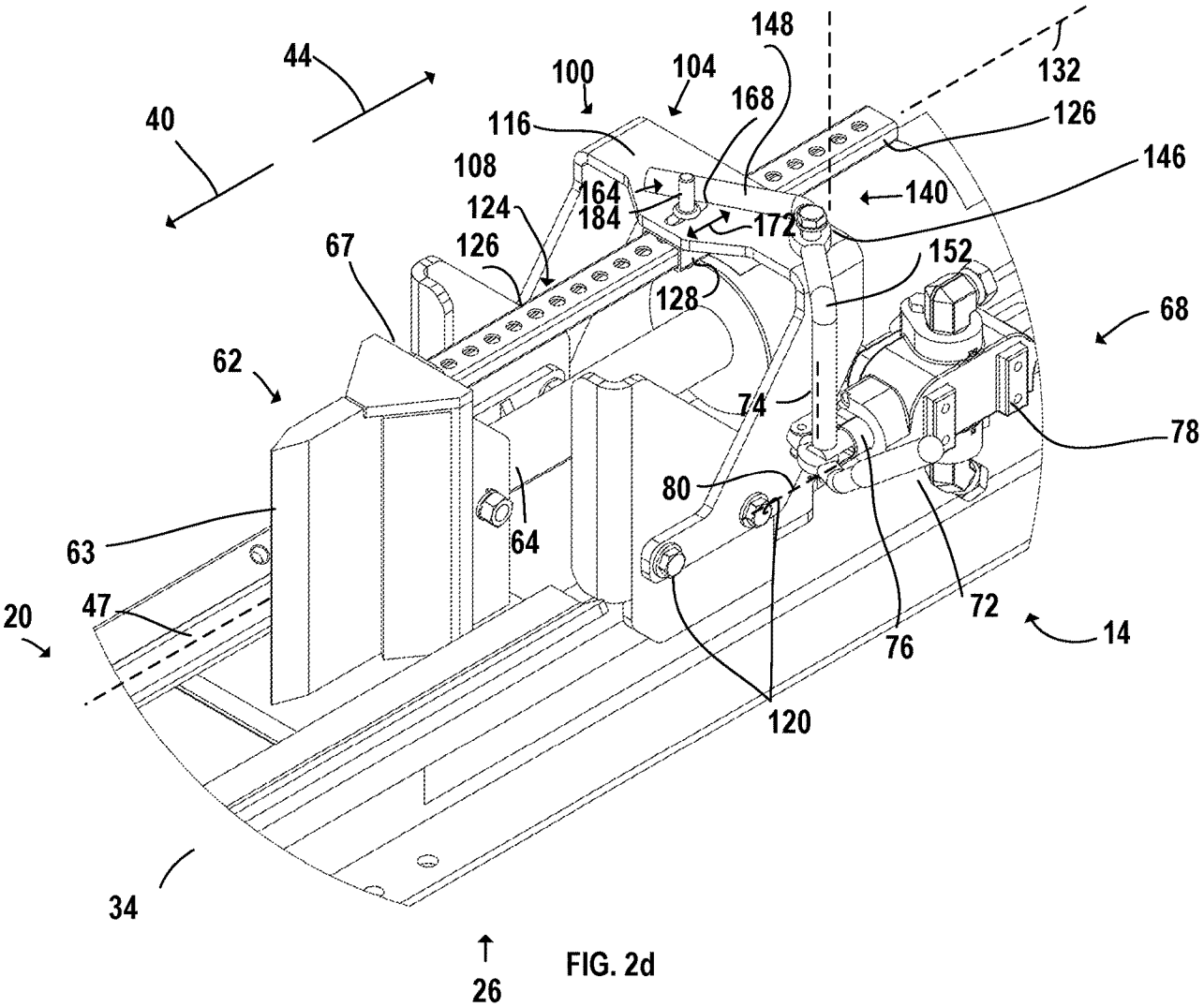
FIG. 2*d* is a close-up perspective view similar to FIG. 2*c*, but with the blade member having applied a linear force to the first mechanical link to cause the first mechanical link to apply a torque to the second mechanical link to pivot the second mechanical link about a pivot axis to move the handle into an intermediate position to deactivate a drive assembly of the log splitting apparatus.

After the operator has manipulated the handle 72 to begin initial retraction of the splitting assembly 65, the operator may advantageously let go of the handle 72 and the stroke reducing device 100 will automatically facilitate stoppage of the splitting assembly 65 when the distance 196 between the foot plate 38 and the front portion 63 of the blade member 62 is again approximately equal to (e.g., slightly larger than) the length of the log that was just split allowing for one or more subsequent logs of the same or similar length to be split. As discussed previously, the splitting assembly 65, during retraction of the same in the second direction 44, contacts the first mechanical link 124 (e.g., the rear portion 67 of the blade assembly contacts the force receiving member 136 or end of the elongated rod 126, see FIG. 2*c*) and applies a force thereto to urge the elongated rod 126 along the translation axis 132 so that the restriction member 164 substantially simultaneously contacts and applies a torque to the second mechanical link 140 to pivot the same about the pivot axis 144 and pull the shaft 76 of the triggering assembly 68 for deactivation of the drive assembly 48. Stated differently, the splitting assembly 65 contacts and forces the first mechanical link 124 in the second direction 44 along the translation axis 132 to torque the second mechanical link 140 about pivot axis 144 and thereby move the handle 72 into its intermediate position of FIG. 2*d*. As also discussed previously, the length 172 of the slot 168 is chosen to restrict movement of the first mechanical link 124 to an amount necessary to move the handle 72 into the intermediate position to inhibit further movement of the splitting assembly 65.

The operator may continue the above process to split additional logs of a similar length. In the event the operator wants to split logs of a different length, the operator may again remove the restriction device 164 from the aperture 180 and the slot 168, reposition the elongated rod 126 by sliding the elongated rod through the passageway 128 to align a different aperture 180 with the slot 168, and then re-insert the restriction device 164 through the slot 168 and the different aperture 180 to achieve a different reduced stroke for the differently sized log(s). While not absolutely required, it is noted how setting back of the platform 116 relative to the first and second mounting brackets 41, 42 and fastening assemblies 120 advantageously increase the degree of adjustability of the elongated rod 126 to accommodate an increasing number of differently sized logs.

The foregoing description has been presented for purposes of illustration and description. Furthermore, the description is not intended to limit the invention to the form disclosed herein. Consequently, variations and modifications commensurate with the above teachings, and skill and knowledge of the relevant art, are within the scope of the disclosure herein. For instance, the restriction device 164 disclosed herein serves a number of functions such as making contact with and torqueing the second mechanical link 140, limiting sliding movement of the first mechanical link 124 to a distance generally defined by the length 172 of the slot 168, and providing adjustability of the elongated rod 126 to accommodate logs of differing lengths. However, other embodiments disclosed herein envision that more than one device or components may serve some of the aforementioned functions.

As another example, while the figures illustrate the blade member 62 as making contact with and forcing the first mechanical link 124 in the second direction 44 along the translation axis 132, other arrangements disclosed herein envision that the piston 64 may alternatively or additionally do so (e.g., such as a separate bracket or member rigidly attached to the piston 64). As a further example, while the first mechanical link 124 is disclosed as inducing clockwise rotation of the second mechanical link 140 about the pivot axis 144 to deactivate the drive assembly 48, it is also envisioned that the stroke reducing device 100 could be configured so that the first mechanical link 124 induces counterclockwise rotation of the second mechanical link 140 about the pivot axis 144 to deactivate the drive assembly 48 (e.g., when the triggering mechanism 68 is located on an opposite side of the frame 14).

Still further, while the handle 72 is disclosed as being pivotal about pivot axis 74 to manipulate the triggering assembly 68 (e.g., the sliding shaft 76 of the triggering assembly), other arrangements disclosed herein envision that the handle 72 may be differently attached to facilitate manipulation of the triggering assembly 68. For instance, the handle 72 in one arrangement may be directly rigidly perpendicularly attached to the shaft 76 so that the handle 72 may be slid along the translation axis 80 to manipulate the shaft 76.

While the second mechanical link 140 is illustrated as having a particular configuration (shape, size, orientation, etc.) so that upon inducement by the first mechanical link 124, the second mechanical link 140 manipulates the triggering assembly 68 (e.g., the shaft 76 and handle 72) to inhibit further retraction of the splitting assembly 65, this disclosure is not so limited. In the event the triggering assembly 68 was positioned in a different location, the two sections of the second arm 152 of the second mechanical link 140 may be positioned at other than 90 degrees to each other as shown in the figures. Furthermore, the second arm 152 may have more or fewer than two sections as shown in the figures.

Still further, while the second arm 152 of the second mechanical link 140 is illustrated as being attached to the triggering assembly 68 in some embodiments (e.g., via rod 156 and locking pin 160), the second arm 152 may only make contact with the triggering assembly 68 in other embodiments. In one arrangement, and as shown in the embodiment of the stroke reducing device 100' of FIGS. 14-15, the second arm 152' may include an outer surface 153 that is configured to contact the handle 72 of the triggering assembly. For instance, the second arm 152' may be configured to extend outwardly past the shaft 76 of the triggering assembly 68 and downwardly so as to be positioned into the range of travel of the handle 72. See FIG. 16.

In this regard, movement of the handle 72 in one rotational direction (e.g., counterclockwise) about the axis 74 activates the triggering assembly 68 to retract the splitting assembly 65 in the second direction 40 and also contacts the outer surface 153 of the second arm 152 to urge the second mechanical link 140 in the counterclockwise direction about pivot axis 144 to position the second arm 148 in contact with or adjacent the second portion 184 of the restriction device 164. Also, upon the restriction member 164 applying a torque to the second mechanical link 140' when it receives a force from the splitting assembly 65 during retraction of the same in the second direction 44, the outer surface 153 of the second arm 152 contacts the handle 72 of the triggering assembly 68 and urges the same in the opposite rotational direction about the axis 74 (e.g., in a clockwise direction) to deactivate the drive assembly 48.

It is also noted that the disclosed stroke reducing device 100 in not limited to use with drive assemblies 48 that include a hydraulic cylinder. The drive assembly 48 may alternatively incorporate various other types of linear actuators (e.g., pneumatic cylinders, mechanical actuators including screws and/or cams, etc.) to advance and retract the blade member 62 or foot plate 38, the stroke of which may be reduced by the disclosed stroke reducing device utilizing a force of the blade member 62 or foot plate 38 being retracted to deactivate the drive assembly and stop the blade member 62 or foot plate 38 short of a full return stroke as disclosed herein.

While this specification contains many specifics, these should not be construed as limitations on the scope of the disclosure or of what may be claimed, but rather as descriptions of features specific to particular embodiments of the disclosure. Furthermore, certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

The embodiments described hereinabove are further intended to explain best modes known of practicing the invention and to enable others skilled in the art to utilize the invention in such, or other embodiments and with various modifications required by the particular application(s) or use(s) of the invention. It is intended that the appended claims be construed to include alternative embodiments to the extent permitted by the prior art.

What is claimed is:

1. An apparatus for splitting logs, comprising:

a frame including a cradle disposed over an upper portion of the frame for receiving a log;

a splitting assembly that is linearly translatable over the upper portion of the frame along a translation axis in a first direction for use in splitting a log received in the cradle and in an opposite second direction;

a drive assembly for linearly translating the splitting assembly along the translation axis in the first and second opposite directions; and a device secured to the frame that is configured to receive a force from the splitting assembly moving in the second direction and use the force to mechanically deactivate the drive assembly and thereby inhibit translation of the splitting assembly along the translation axis, wherein the device includes an anchoring member that is rigidly secured over the frame, wherein the device includes at least one mechanical link movably secured to the anchoring member that mechanically deactivates the drive assembly upon receipt by the device of the force from the splitting assembly moving in the second direction, wherein the at least one mechanical link includes:

a first mechanical link slidably secured to the anchoring member, wherein the first mechanical link includes:

a first sliding member that is slidable in a first sliding slot of the anchoring member; and a second sliding member that is slidable in a second sliding slot of the anchoring member to constrain sliding movement of the first sliding member in the first sliding slot to a predefined linear range, wherein the first sliding member is attached to the second sliding member, and wherein the first sliding slot intersects the second sliding slot; and a second mechanical link movably secured to the anchoring member and configured to contact a triggering mechanism of the drive assembly, wherein receipt by the first mechanical link of the force from the splitting assembly moving in the second direction induces the first mechanical link to move the second mechanical link relative to the anchoring member to manipulate the triggering mechanism of the drive assembly and thereby deactivate the drive assembly.

2. The apparatus of claim 1, wherein the second sliding member is adjustably attachable to the first sliding member to adjust a location at which the splitting assembly contacts the first mechanical link to apply the force in the second direction of movement.

3. The apparatus of claim 2, wherein the second sliding member is a pin, and wherein the pin is adjustably receivable in one of a plurality of apertures of the first sliding member to adjust a location at which the splitting assembly contacts the first mechanical link to apply the force in the second direction of movement.

4. The apparatus of claim 1, wherein the second mechanical link is pivotally secured to the anchoring member about a pivot axis, wherein receipt by the first mechanical link of the force from the splitting assembly moving in the second direction induces the second mechanical link to pivot about the pivot axis and manipulate the triggering mechanism of the drive assembly to deactivate the drive assembly.

5. The apparatus of claim 4, wherein the second mechanical link includes:

a first arm disposed on a first side of the pivot axis; and a second arm disposed on an opposite second side of the pivot axis, wherein the first arm is configured to contact the first mechanical link, and wherein the second arm is configured to contact the triggering assembly.

6. The apparatus claim 1, wherein the anchoring assembly includes:

a first mounting leg secured to the first side portion of the frame;

a second mounting leg secured to the second side portion of the frame; and a platform secured to the first and second mounting legs, wherein the at least one mechanical link is movably secured to the platform.

7. The apparatus of claim 6, wherein the frame includes:

a first mounting bracket on the first side portion thereof, wherein the first mounting leg of the anchoring assembly is secured to the first mounting bracket of the frame; and a second mounting bracket on the second side portion thereof, wherein the second mounting leg of the anchoring assembly is secured to the second mounting bracket of the frame.

8. The apparatus of claim 1, wherein the drive assembly includes a cylinder relative to which a piston is configured to linearly translate to induce linear translation of the splitting assembly.

9. The apparatus of claim 8, wherein the splitting assembly includes the piston and one of a blade member or a foot plate rigidly attached to the piston, wherein the other of the blade member of foot plate is rigidly secured to the first end of the frame, and wherein the splitting assembly is configured to translate towards and away from the other of the blade member or foot plate.

10. An apparatus for adjusting a stroke of a blade member of a log splitting apparatus, comprising:

an anchoring member that is rigidly securable to a frame of a log splitting apparatus;

a first mechanical link that is slidably secured to the anchoring member, wherein the first mechanical link includes:

a first sliding member that is slidable in a first sliding slot of the anchoring member; and a second sliding member that is slidable in a second sliding slot of the anchoring member to constrain sliding movement of the first sliding member in the first sliding slot to a predefined linear range, wherein the first sliding member is attached to the second sliding member, and wherein the first sliding slot intersects the second sliding slot; and a second mechanical link that is pivotally secured to the anchoring member at a pivot axis, wherein receipt by the first mechanical link of a force from a splitting assembly of the log splitting apparatus as the splitting assembly is being retracted by a drive assembly of the log splitting apparatus slides the first mechanical link to induce pivoting of the second mechanical link to deactivate the drive assembly and inhibit further retraction of the splitting assembly.

11. The apparatus of claim 10, wherein the second sliding member is adjustably attachable to the first sliding member to adjust a location at which the splitting assembly contacts the first mechanical link to apply the force.

12. The apparatus of claim 11, wherein the second sliding member is a pin, and wherein the pin is adjustably receivable in one of a plurality of apertures of the first sliding member to adjust a location at which the splitting assembly contacts the first mechanical link to apply the force.

* * * * *